US008622499B2

(12) United States Patent
Kyoso et al.

(10) Patent No.: US 8,622,499 B2
(45) Date of Patent: Jan. 7, 2014

(54) LIQUID EJECTION APPARATUS AND EJECTION CONTROL METHOD FOR SAME, AND INKJET APPARATUS

(75) Inventors: Tadashi Kyoso, Kanagawa (JP); Masakazu Okuda, Kanagawa (JP); Toshinori Ishiyama, Kanagawa (JP)

(73) Assignees: Fujifilm Corporation, Tokyo (JP); Fuji Xerox Co., Ltd., Tokyo (JP)

( * ) Notice: Subject to any disclaimer, the term of this patent is extended or adjusted under 35 U.S.C. 154(b) by 49 days.

(21) Appl. No.: 13/474,385

(22) Filed: May 17, 2012

(65) Prior Publication Data

US 2012/0293577 A1 Nov. 22, 2012

(30) Foreign Application Priority Data

May 19, 2011 (JP) ..... 2011-112522

(51) Int. Cl.
*B41J 29/38* (2006.01)

(52) U.S. Cl.
USPC ..... 347/10

(58) Field of Classification Search
CPC ..... B41J 2/04525; B41J 2/04588
USPC ..... 347/9–12, 68, 70–72
See application file for complete search history.

(56) References Cited

U.S. PATENT DOCUMENTS 6,478,396 B1 * 11/2002 Schloeman et al. ..... 347/12
6,629,741 B1 * 10/2003 Okuda et al. ..... 347/11

FOREIGN PATENT DOCUMENTS

JP 2006-142504 A 6/2006

* cited by examiner

*Primary Examiner* — An Do
(74) *Attorney, Agent, or Firm* — Studebaker & Brackett PC

(57) ABSTRACT

A liquid ejection apparatus includes: a circuit control device including switches of which first ends are connected to pressure generating elements; a voltage waveform generating device configured to generate a voltage waveform to be supplied to second ends of the switches; and a switch control device which causes the switches to close and open. The voltage waveform has a waveform such that, when the switch is caused to close and open so that a portion of the voltage waveform is applied to the pressure generating element, a droplet is ejected from a nozzle corresponding to the pressure generating element to which the portion of the voltage waveform has been applied, whereas when a whole of the voltage waveform is applied to the pressure generating element, no droplet is substantially ejected from the nozzle corresponding to the pressure generating element to which the whole of the voltage waveform has been applied.

20 Claims, 11 Drawing Sheets

| | SUBSIDIARY WAVEFORM A | MAIN WAVEFORM B | EJECTION STATE | RESULTING WAVEFORM |
|---|---|---|---|---|
| NOT DESIGNATED TO EJECT DROPLET | OFF | OFF | NO EJECTION | |
| DESIGNATED TO EJECT DROPLET | OFF | ON | EJECTION | |
| CONNECTED TO SWITCH ABNORMALLY REMAINING CLOSING | ON | ON | NO EJECTION | |

FIG.9

| | SUBSIDIARY WAVEFORMS A, C & E | MAIN WAVEFORM B | MAIN WAVEFORM D | MAIN WAVEFORM F | EJECTION STATE | RESULTING WAVEFORM |
|---|---|---|---|---|---|---|
| NOT DESIGNATED TO EJECT DROPLET | OFF | OFF | OFF | OFF | NO EJECTION | |
| DESIGNATED TO EJECT SMALL DROPLET | OFF | ON | OFF | OFF | EJECTION OF SMALL DROPLET | |
| DESIGNATED TO EJECT MEDIUM DROPLET | OFF | ON | ON | OFF | EJECTION OF MEDIUM DROPLET | |
| DESIGNATED TO EJECT LARGE DROPLET | OFF | ON | ON | ON | EJECTION OF LARGE DROPLET | |
| CONNECTED TO SWITCH ABNORMALLY REMAINING CLOSING | ON | ON | ON | ON | NO EJECTION | |

| | SUBSIDIARY WAVEFORM A | MAIN WAVEFORM B | EJECTION STATE | RESULTING WAVEFORM |
|---|---|---|---|---|
| NOT DESIGNATED TO EJECT DROPLET | OFF | OFF | NO EJECTION | |
| DESIGNATED TO EJECT DROPLET | OFF | ON | EJECTION | |
| CONNECTED TO SWITCH ABNORMALLY REMAINING CLOSING | ON | ON | NO EJECTION (AIR BUBBLE DRAWN IN) | |

LIQUID EJECTION APPARATUS AND EJECTION CONTROL METHOD FOR SAME, AND INKJET APPARATUS

BACKGROUND OF THE INVENTION

1. Field of the Invention

The present invention relates to a liquid ejection apparatus, an ejection control method for a liquid ejection apparatus, and an inkjet apparatus, and more particularly to technology suitable for preventing continual ejection from an ejector (a droplet ejection mechanism) while it suffers a control error due to a breakdown in a circuit control device, or the like.

2. Description of the Related Art

A liquid ejection head such as an inkjet print head includes a plurality of ejectors to eject droplets of liquid. Each ejector is constituted of: a nozzle forming an ejection port, through which droplets of the liquid are ejected; a pressure chamber, which contains the liquid and is connected to the nozzle; and a pressure generating element, which applies ejection energy or pressure to the liquid in the pressure chamber. The pressure generating elements arranged correspondingly to the respective ejectors are connected to a circuit control device through electrical wiring. The circuit control device includes a plurality of switches, which can be caused to close and open in accordance with external signals. The pressure generating elements are connected respectively through the switches to a drive circuit. By controlling the closing/opening states of the switches connected to the pressure generating elements, application of a drive voltage to the pressure generating elements is controlled, and the ejection of droplets from the nozzles is thereby controlled.

In such a composition, there are cases where a part of the circuit control device breaks down and a part of the ejectors becomes uncontrollable, for some reason. For instance, a fault can occur in which a switch connected to a pressure generating element remains closing in spite of the fact that an external control signal is applied to open the switch. In this case, unnecessary ejection is continually performed from an ejector connected to the switch suffering the fault.

In order to solve such problems, Japanese Patent Application Publication No. 2006-142504 describes a method which disables ejection by disconnecting a wire which connects to an ejector that has an ejection abnormality. As a concrete means of achieving this, a method of cutting the wire by applying a laser from a nozzle face side of a liquid ejection head is described. However, this method can be implemented only to a case where the wire connected to the ejector having an ejection abnormality is situated close to the nozzle plate. Furthermore, when an ejection abnormality has occurred in a print head that has been installed in an inkjet apparatus, the aforementioned method cannot be employed unless the print head is removed from the inkjet apparatus. Supposing that a composition is adopted in which a laser generating apparatus is appended to an inkjet apparatus, then the costs rise accordingly.

SUMMARY OF THE INVENTION

The present invention has been contrived in view of these circumstances, an object thereof being to provide a liquid ejection apparatus, an ejection control method for a liquid ejection apparatus, and an inkjet apparatus, whereby continual ejection can be prevented and use of a head can be continued, without replacement or repair of the head, in cases where a control defect, such as breakdown of a circuit control device (ASIC), or the like, has occurred.

In order to attain the aforementioned object, the present invention is directed to a liquid ejection apparatus, comprising: a plurality of nozzles each of which is configured to serve as an ejection port from which a droplet of liquid is ejected; a plurality of pressure generating elements which are arranged correspondingly to the nozzles, each of the pressure generating elements being configured to generate ejection energy to eject the droplet from a corresponding one of the nozzles; a circuit control device including a plurality of switches of which first ends are connected respectively to the pressure generating elements corresponding to the nozzles; a voltage waveform generating device configured to generate a voltage waveform to be supplied to second ends of the switches of which the first ends are connected to the pressure generating elements; and a switch control device which outputs a control signal to cause each of the switches to close and open, wherein the voltage waveform generated by the voltage waveform generating device has a waveform such that, when one of the switches is caused to close and open according to the control signal so that a portion of the voltage waveform is applied to one of the pressure generating elements connected to the one of the switches, a droplet of the liquid is ejected from one of the nozzles corresponding to the one of the pressure generating elements to which the portion of the voltage waveform has been applied, whereas when a whole of the voltage waveform is applied to the one of the pressure generating elements, no droplet of the liquid is substantially ejected from the one of the nozzles corresponding to the one of the pressure generating elements to which the whole of the voltage waveform has been applied.

According to this aspect of the present invention, droplets are ejected from the nozzles by controlling the closing and opening of the switches connected to the pressure generating elements so as to apply the portion of the voltage waveform to the pressure generating elements. If a switch becomes uncontrollable and remains constantly closing, then the whole of the pressure waveform is applied to the pressure generating element connected to that switch. In this case, no droplet is substantially ejected from the corresponding nozzle.

Preferably, the voltage waveform includes a main waveform section and a subsidiary waveform section, the main waveform section being for ejection driving to cause ejection of the droplet from the one of the nozzles when the main waveform section is applied to the one of the pressure generating elements, the subsidiary waveform section being for suppressing the ejection of the droplet from the one of the nozzles when the subsidiary waveform section is applied to the one of the pressure generating elements in combination with the main waveform section.

This aspect of the present invention employs a composition using the voltage waveform in which the main waveform section and the subsidiary waveform section are combined by time division. According to this aspect, it is possible to perform ejection when the main waveform section only is applied to the pressure generating element. No ejection is substantially performed when both the main waveform section and the subsidiary waveform section are applied.

Preferably, the subsidiary waveform section precedes the main waveform section in the voltage waveform.

The subsidiary waveform section for suppressing ejection due to be caused by the main waveform section can be situated before or after the main waveform section, or it is also possible that two subsidiary waveform sections are situated both before and after the main waveform section. It is preferable that the voltage waveform has the composition in which the subsidiary waveform section is added before the main waveform section.

Preferably, the voltage waveform is formed by combining the subsidiary waveform section and the main waveform section in such a manner that a pressure wave generated in the liquid by the one of the pressure generating elements being applied with the subsidiary waveform section cancels at least a portion of a pressure wave generated in the liquid by the one of the pressure generating elements being applied with the main waveform section.

According to this aspect of the present invention, it is possible to reduce the ejection efficiency upon application of the main waveform section, and a state where no droplet is substantially ejected can be achieved when both the main waveform section and the subsidiary waveform section are applied.

Preferably, the liquid ejection apparatus further comprises: a liquid ejection head including a plurality of ejectors which respectively have: the nozzles; a plurality of pressure chambers which are connected respectively to the nozzles; and the pressure generating elements which are arranged correspondingly to the pressure chambers, wherein: the subsidiary waveform section includes a first waveform element which produces a voltage change of one of fall and rise; the main waveform section includes a second waveform element which produces a voltage change of the one of fall and rise same with the first waveform element of the subsidiary waveform section; a pressure chamber system including one of the pressure chambers and the liquid contained in the one of the pressure chambers has a resonance period of Tc; and the first waveform element of the subsidiary waveform section and the second waveform element of the main waveform section are separated from each other by a time interval of $(2n+1)\times(Tc/2)$, where n is an integer not less than 0.

According to this aspect of the present invention, the voltage waveform is composed in such a manner that the voltage change portions in the same direction, such as the falling portions, or the rising portions, of the subsidiary waveform section and the main waveform section, are separated by an odd multiple of the half resonance period (Tc/2) of the pressure chamber system. By this aspect, it is possible to effectively neutralize the pressure wave.

It is also preferable that the liquid ejection apparatus further comprises: a liquid ejection head including a plurality of ejectors which respectively have: the nozzles; a plurality of pressure chambers which are connected respectively to the nozzles; and the pressure generating elements which are arranged correspondingly to the pressure chambers, wherein: the subsidiary waveform section includes a first waveform element which produces a voltage change of one of fall and rise; the main waveform section includes a second waveform element which produces a voltage change of another of fall and rise opposing to the first waveform element of the subsidiary waveform section; a pressure chamber system including one of the pressure chambers and the liquid contained in the one of the pressure chambers has a resonance period of Tc; and the first waveform element of the subsidiary waveform section and the second waveform element of the main waveform section are separated from each other by a time interval of $(n+1)\times Tc$, where n is an integer not less than 0.

According to this aspect of the present invention, the voltage waveform is composed in such a manner that the voltage change portions in opposite directions are separated by an integral multiple of the resonance period Tc of the pressure chamber system, such as the rising portion of the subsidiary waveform section and the falling portion of the main waveform section, or the falling portion of the subsidiary waveform section and the rising portion of the main waveform section. By this aspect, it is possible to effectively neutralize the pressure wave.

Preferably, a voltage amplitude of the subsidiary waveform section is not smaller than a voltage amplitude of the main waveform section.

According to this aspect of the present invention, it is possible to effectively reduce the ejection efficiency upon application of the main waveform section, by means of the subsidiary waveform section.

Preferably, a lowest voltage in the subsidiary waveform section is not higher than a lowest voltage in the main waveform section.

According to this aspect of the present invention, it is possible to effectively reduce the ejection efficiency upon application of the main waveform section, by means of the subsidiary waveform section.

Preferably, the voltage waveform includes a plurality of the main waveform sections and a plurality of the subsidiary waveform sections in one recording period.

According to this aspect of the present invention, it is possible to adopt the voltage waveform composition in which a plurality of combinations of the subsidiary waveform and the main waveform are joined together.

By changing the number of main waveforms applied to the pressure generating element, of the plurality of main waveforms, it is possible to alter the ejected droplet volume.

Preferably, a part of the subsidiary waveform section includes a waveform element which produces a stepwise voltage rise.

According to this aspect of the present invention, the ejection efficiency of the subsidiary waveform section is lowered, and therefore ejection upon application of the subsidiary waveform section can be effectively suppressed.

It is also preferable that a part of the subsidiary waveform section includes a waveform element which produces a voltage rise following an S-shaped curve.

According to this aspect of the present invention, the ejection efficiency of the subsidiary waveform section is lowered, and therefore ejection upon application of the subsidiary waveform section can be effectively suppressed.

It is also preferable that the subsidiary waveform section precedes the main waveform section in the voltage waveform; and when the subsidiary waveform section is applied to the one of the pressure generating elements, an air bubble is drawn inside the nozzle corresponding to the one of the pressure generating elements, and ejection due to be caused by the main waveform section is suppressed by the air bubble.

According to this aspect of the present invention, it is possible to achieve a state where no ejection is substantially performed when both the main waveform section and the subsidiary waveform section are applied.

In order to attain the aforementioned object, the present invention is also directed to an inkjet apparatus, comprising: the above-described liquid ejection apparatus; and a medium conveyance device which conveys a recording medium on which droplets ejected from the nozzles are deposited.

In order to attain the aforementioned object, the present invention is also directed to an ejection control method for a liquid ejection apparatus which includes: a plurality of nozzles each of which is configured to serve as an ejection port from which a droplet of liquid is ejected; a plurality of pressure generating elements which are arranged correspondingly to the nozzles, each of the pressure generating elements being configured to generate ejection energy to eject the droplet from a corresponding one of the nozzles; a circuit control device including a plurality of switches of which first ends are connected respectively to the pressure generating elements corresponding to the nozzles; a voltage waveform generating device configured to generate a voltage waveform to be supplied to second ends of the switches of which the first ends are connected to the pressure generating elements; and a switch control device which outputs a control signal to cause each of the switches to close and open, the ejection control method comprising the steps of: supplying the voltage waveform to the second ends of the switches, the voltage waveform having a waveform such that when a whole of the voltage waveform is applied to one of the pressure generating elements, no droplet of the liquid is substantially ejected from one of the nozzles corresponding to the one of the pressure generating elements to which the whole of the voltage waveform has been applied; and causing one of the switches to close and open by the control signal so that a portion of the voltage waveform is applied to one of the pressure generating elements connected to the one of the switches, and thereby ejecting a droplet of the liquid from one of the nozzles corresponding to the one of the pressure generating elements to which the portion of the voltage waveform has been applied.

According to this aspect of the present invention, it is possible to manufacture a printed item, a circuit board, a device and a fine structure, and the like. Therefore, the method according to this aspect of the present invention can also be understood as a method of manufacturing these printed items, or the like.

Preferably, the voltage waveform includes a main waveform section and a subsidiary waveform section, the main waveform section being for ejection driving to cause ejection of the droplet from the one of the nozzles when the main waveform section is applied to the one of the pressure generating elements, the subsidiary waveform section being for suppressing the ejection of the droplet from the one of the nozzles when the subsidiary waveform section is applied to the one of the pressure generating elements in combination with the main waveform section.

Preferably, the voltage waveform is formed by combining the subsidiary waveform section and the main waveform section in such a manner that a pressure wave generated in the liquid by the one of the pressure generating elements being applied with the subsidiary waveform section cancels at least a portion of a pressure wave generated in the liquid by the one of the pressure generating elements being applied with the main waveform section.

Preferably, the liquid ejection apparatus further includes a liquid ejection head including a plurality of ejectors which respectively have: the nozzles; a plurality of pressure chambers which are connected respectively to the nozzles; and the pressure generating elements which are arranged correspondingly to the pressure chambers; the subsidiary waveform section includes a first waveform element which produces a voltage change of one of fall and rise; the main waveform section includes a second waveform element which produces a voltage change of the one of fall and rise same with the first waveform element of the subsidiary waveform section; a pressure chamber system including one of the pressure chambers and the liquid contained in the one of the pressure chambers has a resonance period of Tc; and the first waveform element of the subsidiary waveform section and the second waveform element of the main waveform section are separated from each other by a time interval of $(2n+1)\times(Tc/2)$, where n is an integer not less than 0.

It is also preferable that the liquid ejection apparatus further includes a liquid ejection head including a plurality of ejectors which respectively have: the nozzles; a plurality of pressure chambers which are connected respectively to the nozzles; and the pressure generating elements which are arranged correspondingly to the pressure chambers; the subsidiary waveform section includes a first waveform element which produces a voltage change of one of fall and rise; the main waveform section includes a second waveform element which produces a voltage change of another of fall and rise opposing to the first waveform element of the subsidiary waveform section; a pressure chamber system including one of the pressure chambers and the liquid contained in the one of the pressure chambers has a resonance period of Tc; and the first waveform element of the subsidiary waveform section and the second waveform element of the main waveform section are separated from each other by a time interval of $(n+1)\times Tc$, where n is an integer not less than 0.

Preferably, the voltage waveform includes a plurality of the main waveform sections and a plurality of the subsidiary waveform sections in one recording period.

Preferably, the subsidiary waveform section precedes the main waveform section in the voltage waveform; and when the subsidiary waveform section is applied to the one of the pressure generating elements, an air bubble is drawn inside the nozzle corresponding to the one of the pressure generating elements, and ejection due to be caused by the main waveform section is suppressed by the air bubble.

According to the present invention, if a switch connected to a pressure generating element becomes uncontrollable and remains constantly closing because of a fault in the switch, or the like, then no droplet is substantially ejected from the corresponding nozzle. Consequently, it is possible to prevent continual ejection from the uncontrollable ejector.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 9 is a table showing the relationship between a selection pattern of a subsidiary waveform and a main waveform when using the drive waveform in FIG. 8, and an ejection state (whether a droplet is substantially ejected or not);

DETAILED DESCRIPTION OF THE PREFERRED EMBODIMENTS

Configuration of Droplet Ejection Apparatus

Figure 1:
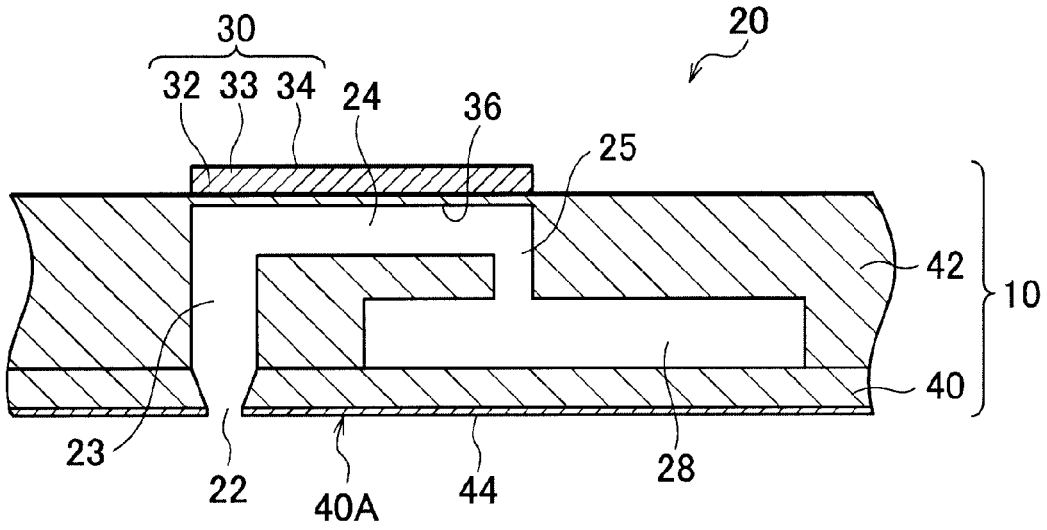
FIG. 1 is a cross-sectional diagram showing an internal structure of an inkjet head.

Here, an inkjet head using piezoelectric elements as pressure generating elements and an inkjet apparatus equipped with this inkjet head are described. FIG. 1 is a cross-sectional diagram showing an internal structure of an inkjet head 10 (serving as a "liquid ejection head") according to an embodiment of the present invention. Although FIG. 1 shows one ejector 20 only, the inkjet head 10 has a plurality of ejectors 20. Each of the ejectors 20 includes: a nozzle 22 serving as a droplet ejection port; a pressure chamber 24, which is connected to the nozzle 22 and contains liquid (e.g., ink in the present embodiment); and a pressure generating element 30, which generates a pressure change for applying ejection energy to the ink in the pressure chamber 24.

Figure 2:
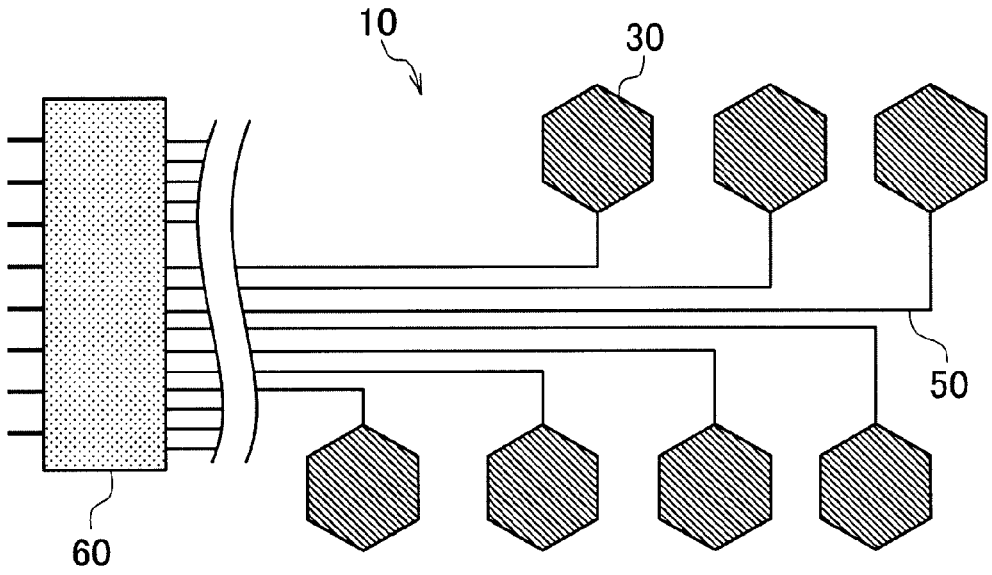
FIG. 2 is a plan diagram showing a schematic view of the principal composition of a liquid ejection apparatus.

The pressure chamber 24 in the present embodiment has a substantially hexagonal planar shape (see FIG. 2). A nozzle flow channel 23 connecting to the nozzle 22 is arranged at one corner section on a diagonal of the hexagonal planar shape, and a supply port 25 serving as an ink inlet port to the pressure chamber 24 is arranged at the other corner section on the diagonal. The shape of the pressure chamber 24 is not limited to the composition of the present embodiment, and various modes are possible in which the planar shape is a quadrilateral shape (rhombic shape, rectangular shape, or the like), a pentagonal shape, or another polygonal shape, or a circular shape, an elliptical shape, or the like.

The respective pressure chambers 24 are connected to a common flow channel 28 through the supply ports 25. The common flow channel 28 is connected to an ink tank (an ink supply source, not shown) though a flow channel (not shown). The ink supplied from the ink tank is sent to the pressure chambers 24 through the common flow channel 28.

The pressure generating elements 30 in the present embodiment are piezoelectric elements, each of which has a layered structure constituted of a lower electrode (common electrode) 32, a piezoelectric body 33 and an upper electrode (individual electrode) 34. A diaphragm 36 forming a portion of a face (e.g., the ceiling face in FIG. 1) of the pressure chamber 24 is made of silicon (Si), and is provided with a metal layer (conductive layer) serving as the common electrode corresponding to the lower electrode 32 of the pressure generating element 30. The material of the diaphragm 36 is not limited to silicon, and a mode is also possible in which a diaphragm is made from a non-conductive material, such as resin, in which case, the common electrode layer made of a conductive material, such as metal, is formed on the surface of the diaphragm material. Furthermore, a diaphragm that also serves as a common electrode can be made of a metal (conductive material), such as stainless steel (SUS), or the like.

The structure in which the pressure generating element 30 is arranged on the diaphragm 36 forms a piezoelectric unimorph actuator. When a voltage is applied between the lower electrode 32 and the upper electrode 34 of the pressure generating element 30, the piezoelectric body 33 is deformed, and the volume of the pressure chamber 24 is changed by deformation of the diaphragm 36. This change in volume produces a pressure change in the ink contained in the pressure chamber 24, which causes the ink to be ejected from the nozzle 22. When the pressure generating element 30 returns to the original position after the ejection of the ink, the pressure chamber 24 is refilled with new ink from the common flow channel 28 through the supply port 25. In the present embodiment, the diaphragm 36 is caused to bend by means of the $d_{31}$ mode strain deformation of the piezoelectric body; however, it is also possible to adopt the $d_{33}$ mode deformation or the shear mode deformation of the piezoelectric body to bend the diaphragm to cause the ejection.

The inkjet head 10 having the composition shown in FIG. 1 can be manufactured by arranging and bonding together a nozzle plate 40, in which the nozzles 22 are formed, and a flow channel plate 42, in which the pressure chambers 24 corresponding to the nozzles 22 and flow channels, such as a common flow channel 28, are formed. The nozzles 22 are arranged in a two-dimensional configuration in the nozzle plate 40, and a liquid repelling film 44 having liquid repelling properties is formed on the ink ejection surface (nozzle surface) 40A of the nozzle plate 40.

The flow channel plate 42 is a flow channel forming member which forms side walls of the pressure chambers 24 and in which the supply ports 25 are formed to serve as restricting sections (the most constricted parts) of the individual supply channels for supplying the ink to the respective pressure chambers 24 from the common flow channel 28. Although the simplified view is given in FIG. 1, the flow channel plate 42 can have a layered structure formed of a plurality of substrates. Each of the nozzle plate 40 and the flow channel plate 42 can be processed into a desired shape by a semiconductor device manufacturing process using silicon as a material.

FIG. 2 is a plan diagram showing a schematic view of a principal composition of the liquid ejection apparatus according to the present embodiment. As shown in FIG. 2, the pressure generating elements 30 are arranged so as to correspond to the arrangement of the ejectors 20 (shown in FIG. 1) in the inkjet head 10. The pressure generating elements 30 are connected to a circuit control device 60 through electrical wires 50.

Figure 3:
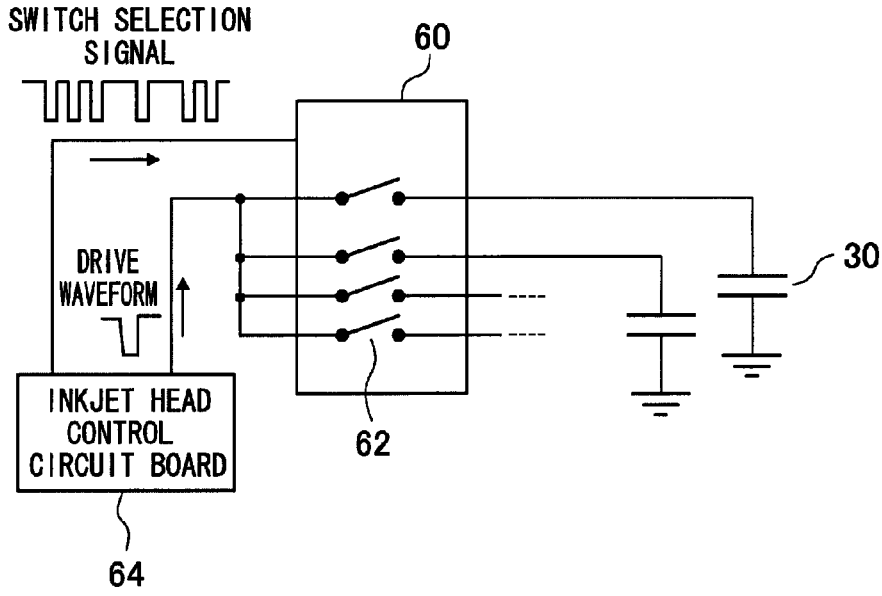
FIG. 3 is a simplified circuit diagram of the liquid ejection apparatus according to an embodiment of the present invention.

FIG. 3 is a simplified circuit diagram of the liquid ejection apparatus according to the present embodiment. In FIG. 3, the number of pressure generating elements 30 depicted is reduced to simplify the drawing. As shown in FIG. 3, the circuit control device 60 includes a plurality of switches 62. The switches 62 are connected respectively to the pressure generating elements 30. The switches 62 are controlled so as to close or open in accordance with a control signal (switch selection signal) applied from an external source. The circuit control device 60 includes a control unit that causes, in accordance with an inputted switch selection signal, the selected switches 62 to close or open. The circuit control device 60 can be constituted of an application specific integrated circuit (ASIC).

An inkjet head control circuit board 64 functions as a drive control device (head drive device) for performing ejection by driving the pressure generating elements 30 of the inkjet head 10. The inkjet head control circuit board 64 includes an output circuit (not shown) for the switch selection signal to command the switches 62 to close or open. The switch selection signal is for controlling the closing/opening state of each of the switches 62 in the circuit control device 60. The closing/opening state of each of the switches 62 is changed in accordance with the switch selection signal.

The inkjet head control circuit board 64 includes a waveform memory, which stores data for a voltage waveform (a drive waveform) to be applied to the pressure generating elements 30, and a drive voltage output circuit (not shown), which outputs a drive waveform signal (drive signal) corresponding to the drive waveform data. The waveform memory stores the drive waveform data (shown in FIGS. 5, 7, 8, and 10 to 14) for one printing cycle to perform recording of one pixel (one droplet deposition point) as specified by the recording resolution, of which the details are described later.

As shown in FIG. 3, the drive waveform (voltage waveform) outputted from the inkjet head control circuit board 64 is applied parallelly to ends of the switches 62, of which the other ends are connected respectively to the pressure generating elements 30. The circuit control device 60 causes each of the switches 62 connected to the respective pressure generating elements 30, to close or open by using the switch selection signal applied from the inkjet head control circuit board 64. The application or non-application of the drive voltage to each of the pressure generating elements 30 is controlled by the close/open switching of the corresponding one of the switches 62.

It is possible to cause each of the switches 62 to close and open during one drive waveform so as to apply only a required portion of the whole drive waveform (hereinafter, a unit of the drive waveform corresponding to one recording period is referred to as "one drive waveform") to the corresponding one of the pressure generating elements 30. Control signals to cause the switch to close and open in one drive waveform are referred to as latch signals. The latch signals are included in the switch selection signal.

<Technical Problem>

Figure 4:
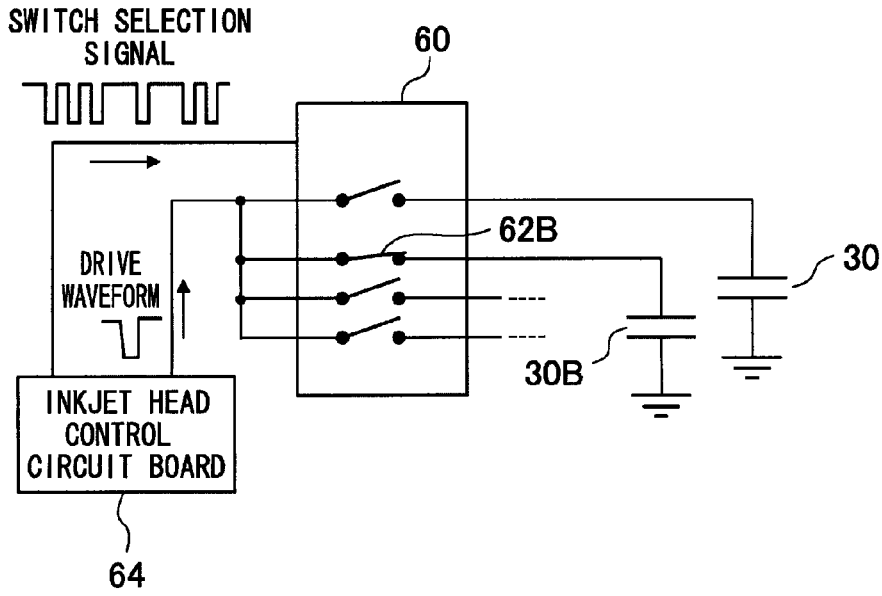
FIG. 4 is an illustrative diagram showing a case where a circuit control device has broken down.

FIG. 4 is an illustrative diagram of a case where a part of the circuit control device 60 has broken down. When there is a switch 62B that has broken down in the circuit control device 60 as shown in FIG. 4, the pressure generating element 30B connected with the switch 62B is continually driven even if no ejection is desired.

In this way, there are cases where the particular switch 62B remains closing, irrespective of the switch selection signal applied from the inkjet head control circuit board 64. In this case, the whole of the drive waveform is applied at all times to the pressure generating element 30B connected to the particular switch 62B, and therefore an undesirable image is produced on the paper.

This problem is resolved as follows.

First Embodiment

First Drive Waveform

Figures 5, 6:
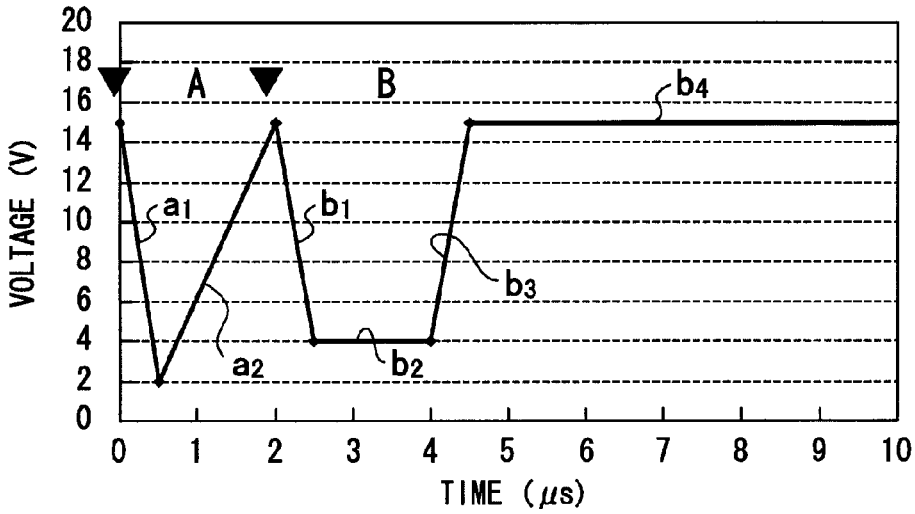
FIG. 5 is a waveform diagram of a drive waveform according to a first embodiment.
FIG. 6 is a table showing the relationship between a selection pattern of a subsidiary waveform and a main waveform when using the drive waveform in FIG. 5, and an ejection state (whether a droplet is substantially ejected or not)

FIG. 5 shows a drive waveform according to the first embodiment. This drive waveform is of one recording period, in which dot recording of one pixel on the recording medium is performed. The term "one recording period" is also be known in the technical field as "one printing period".

The waveform data of the drive waveform shown in FIG. 5 is stored in the waveform memory on the inkjet head control circuit board 64. In FIG. 5, the horizontal axis indicates time (in microsecond (μs)) and the vertical axis indicates voltage (in volt (V)). The drive waveform shown in FIG. 5 includes a waveform section A ranging from 0.0 μs to 2.0 μs, and a waveform section B ranging from 2.0 μs to 10.0 μs subsequent to the waveform section A. The waveform section A is referred to as a "subsidiary waveform", the waveform section B is referred to as a "main waveform", and they are also referred to as the "subsidiary waveform A" and the "main waveform B" in the specification. The main waveform B serves as a waveform section for driving ejection. The subsidiary waveform A serves as an ejection suppressing waveform section that suppresses ejection when combined with the main waveform B.

The waveform section A in FIG. 5 is constituted of a falling waveform element a1 and a rising waveform element a2 subsequent to the waveform element a1. The potential falls from a reference potential Vref (=15 V) to a potential Va (=2 V) in the falling waveform element a1, and then rises from the potential Va (=2 V) to the reference potential Vref (=15 V) in the rising waveform element a2.

The waveform section B in FIG. 5 is constituted of a falling waveform element b1, a holding waveform element b2 subsequent to the waveform element b1, a rising waveform element b3 subsequent to the waveform element b2, and a holding waveform element b4 subsequent to the waveform element b3. The potential falls from the reference potential Vref (=15 V) to a potential Vb (=4 V) in the falling waveform element b1, then holds the potential Vb (=4 V) in the holding waveform element b2, then rises from the potential Vb to the reference potential Vref (=15 V) in the rising waveform element b3, and then holds the reference potential Vref (=15 V) in the holding waveform element b4.

The pulse that is composed of the waveform elements b1, b2 and b3 is a so-called pull-push waveform. More specifically, the waveform element b1 performs driving of a "pull" action to deform the piezoelectric element (the pressure generating element 30 in FIG. 1) in a direction to expand the capacity of the pressure chamber. The waveform element b2 maintains or holds the pressure chamber in the expanded state caused by the pull action of the waveform element b1. The waveform element b3 performs driving of a "push" action to deform the piezoelectric element in a direction to contract the capacity of the pressure chamber.

In the subsidiary waveform A in FIG. 5, the waveform element a1 corresponds to the "pull" action, and the waveform element a2 corresponds to the "push" action. The pressure system of the inkjet head 10 in the present embodiment has the Helmholtz resonance period (intrinsic period) Tc of 4 μs. The time points (the values on the time axis) corresponding to the starts and ends of the waveform elements a1, a2, b1, b2, b3 and b4 or the boundaries between the waveform elements are 0.0 μs, 0.5 μs, 2.0 μs, 2.5 μs, 4.0 μs, 4.5 μs and 32.1 μs.

In FIG. 5, down-pointing triangles indicate latch timings. The closing and opening of each switch 62 in FIG. 3 is controlled at these latch timings, thereby selecting whether to cause a voltage to be applied (i.e., "on") or not to be applied (i.e., "off") to the corresponding one of the pressure generating elements 30. Of the two latch timings indicated with the down-pointing triangles in FIG. 5, the latch timing before the first waveform section A is referred to as the latch timing 1, and the latch timing before the subsequent waveform section B is referred to as the latch timing 2.

It is selected whether or not to apply the subsidiary waveform A to the pressure generating element by closing or opening the switch at the latch timing 1 before the start of the subsidiary waveform A. It is selected whether or not to apply the main waveform B to the pressure generating element by closing or opening the switch at the latch timing 2 before the start of the main waveform B.

It is determined when and which of the nozzles in the inkjet head 10 are to eject droplets, by applying image processing, such as RIP (raster image processor) to the image file (a PDF file, a TIFF file, or the like) to be printed.

In the case of the pressure generating elements corresponding to the nozzles which are selected to perform ejection, the subsidiary waveform A is off at the latch timing 1 and the main waveform B is on at the latch timing 2. In the case of the pressure generating elements corresponding to the nozzles which are not selected to perform ejection, the subsidiary waveform A is off at the latch timing 1 and the main waveform B is off at the latch timing 2. When there is no fault in the circuit control device 60, the ejection control is normally performed by means of these control procedures.

When the switch 62B in the circuit control device 60 is defective for any reason as described with reference to FIG. 4, the closing and opening of the switch 62B cannot be controlled at the latch timing 1 and the latch timing 2, and then both the subsidiary waveform A and the main waveform B are applied to the pressure generating element 30B that is connected to the uncontrollable switch 62B.

However, the drive waveform shown in FIG. 5 does not cause any droplet to be substantially ejected from the nozzle when the subsidiary waveform A and the main waveform B are consecutively applied to the corresponding pressure generating element. This is because the subsidiary waveform A is designed in such a manner that the pressure wave caused by the subsidiary waveform A (more specifically, the pressure wave that is produced in the ink in the pressure chamber by the corresponding pressure generating element applied with the voltage of the subsidiary waveform A) can cancel at least a portion of the pressure wave caused by the main waveform B. To give a concrete description with reference to the waveform in FIG. 5, the pressure wave caused by the falling portion (the waveform element a1) of the subsidiary waveform A can cancel the pressure wave caused by the falling portion (the waveform element b1) of the main waveform B. Thus, when the subsidiary waveform A and the main waveform B are consecutively applied to the pressure generating element, no droplet is substantially ejected from the corresponding nozzle.

In order to neutralize the pressure wave in this way, it is effective to design the drive waveform by taking account of the Helmholtz resonance period Tc of the pressure chamber system (also referred to as the "head resonance period"). The resonance period Tc of the pressure chamber system is the intrinsic period of the whole vibration system, which depends on the dimensions, material and physical values of the ink flow channel system, the ink (acoustic element), the piezoelectric element, and the like. The resonance period Tc can be determined by calculation from the head design values (including the physical values of the ink used). The determination of the resonance period Tc is not limited to the estimation based on the head design values, and it is also possible to measure the resonance period Tc by experimentation.

For example, an experiment is carried out to investigate the droplet ejection conditions of the pressure chamber system by applying a simple square wave to the pressure generating element. When the speed and volume of the ejected droplets are investigated while the pulse width of the square wave applied to the pressure generating element is gradually varied, each of the droplet speed and the droplet volume describes a hill shaped curve with the change in the pulse width, and has a turning point or a peak at which the value changes from increase to decrease. The pulse width at which the droplet speed has the peak (maximum value) and the pulse width at which the droplet volume has the peak do not necessarily coincide and rather a slight deviation can occur therebetween, but from these measurement results, approximately two times the pulse width at which the peak appears is calculated as the resonance period Tc of the pressure chamber system.

The resonance period Tc of the pressure chamber system in the inkjet head 10 is 4 μs in the present embodiment. In this case, the half resonance period (Tc/2) is 2 μs. The drive waveform shown in FIG. 5 is designed so that the falling portion (the waveform element a1) of the subsidiary waveform A and the falling portion (the waveform element b1) of the main waveform B are separated from each other by approximately 2 μs (which is equal to the half resonance period), from the viewpoint of reducing the ejection efficiency upon application of the main waveform B by applying the subsidiary waveform A preceding the main waveform B.

Thus, the pressure wave caused by the waveform element a1 and the pressure wave caused by the waveform element b1 can cancel each other, and the pressure wave can be effectively neutralized.

<Desirable Conditions of the Main Waveform and the Subsidiary Waveform>

In the case of the inkjet head based on the piezoelectric inkjet system, the ejection mechanism (ejector 20) of one nozzle has the composition in which the piezoelectric element is arranged on the pressure chamber connected to the nozzle aperture (ejection port), and a pressure variation is applied to the ink in the pressure chamber by driving the piezoelectric element so that a droplet of the ink is ejected from the nozzle aperture. In the main waveform B shown in FIG. 5, when the voltage applied to the piezoelectric element falls from the reference potential, the pressure chamber expands and thereby the pressure applied to the ink in the pressure chamber falls, so that the meniscus of the ink inside the nozzle is pulled in the direction toward the pressure chamber (the direction opposite to the ejection direction). While the fallen voltage is held (by the waveform element b2) after the pull-in operation of the meniscus by the application of the "pull" waveform element b1, the meniscus vibrates with the resonance period of the vibration system. When the voltage of the waveform element b3 is applied to the piezoelectric element at the time that the moving speed of the vibrating meniscus in the ejection direction reaches a maximum, the pressure chamber contracts and thereby the meniscus of the ink inside the nozzle is pushed, so that a droplet of the ink can be ejected from the nozzle at the time that the meniscus achieves the maximum acceleration. Efficient ejection is possible by adjusting the pull-push cycle produced by the drive waveform with the movement of the meniscus.

Since one period of the meniscus vibration is one resonance period Tc, then the best ejection efficiency is achieved by adjusting the driving pulse width to the half resonance period (Tc/2) approximately. The drive waveform 10 shown in FIG. 5 is an example in which the pulse width is substantially the same as Tc/2.

As shown in FIG. 5, when the subsidiary waveform A is arranged before the main waveform B, the drive waveform is designed in such a manner that no ejection is substantially caused by the subsidiary waveform A. When the triangular waveform constituted of the waveform elements a1 and a2 shown in FIG. 5 alone is applied to the pressure generating element 30, no droplet of the ink is substantially ejected from the corresponding nozzle. This is because the subsidiary waveform A in FIG. 5 does not have a pulse width corresponding to the intrinsic vibration (resonance) of the pressure chamber system, and no pressure wave required for ejection is efficiently generated in the ink in the pressure chamber.

The subsidiary waveform A preceding the main waveform B is required not to substantially cause ejection when the subsidiary waveform A is applied to the pressure generating element 30, as well as suppressing ejection to be caused by the application of the following main waveform B (i.e., cancelling the pressure wave caused by the following main waveform B). Experimentation and simulation carried out by the inventors have revealed that it is desirable that the minimum voltage (Va) of the subsidiary waveform (the triangular waveform in FIG. 5) is not higher than the minimum voltage (Vb) of the main waveform (the trapezoidal waveform in FIG. 5), and it is more desirable that the minimum voltage (Va) of the subsidiary waveform is lower than the minimum voltage (Vb) of the main waveform.

In FIG. 5, the minimum voltage of the subsidiary waveform A (the potential Va=2 V) is set to be lower than the minimum voltage of the main waveform B (the potential Vb=4 V). This is because experimentation and simulation carried out by the inventors have revealed that a composition satisfying the condition Va<Vb has a great effect in neutralizing the pressure wave (in suppressing the ejection efficiency).

As a result of investigating the ejection state while varying the conditions of the minimum voltage (the potential Va) of the subsidiary waveform, it has been found desirable that the minimum voltage (the potential Va) of the subsidiary waveform is set to be lower by 0% to 30% with respect to the voltage amplitude of the main waveform (which is the potential difference between the reference potential Vref and the minimum potential Vb in the main waveform, and is 11 V in FIG. 5). In FIG. 5, the minimum voltage of the subsidiary waveform A is set to 2 V, which is lower by 18% with respect to the voltage amplitude (11 V) of the main waveform B.

In the present embodiment, the above-described relationship is adopted since the pressure chamber is caused to expand when the voltage applied to the corresponding pressure generating element falls and the pressure chamber is caused to contract when the voltage rises; however, it is also possible to adopt a driving method in which the pressure chamber is caused to expand by a rising voltage and the pressure chamber is caused to contract by a falling voltage. In this case, when the potential difference within the pulse (waveform section) with respect to the reference potential is taken as the voltage amplitude of the pulse, it is desirable that the voltage amplitude of the subsidiary waveform A is not smaller than the voltage amplitude of the main waveform B.

In general, in order to cause the switch 62 to close or open by applying the latch signal as shown in FIG. 5, it is required a time of approximately 0.1 μs to 1 μs, which the duration depends on the characteristics of the drive circuit and the ASIC. When the switch 62 is controlled to stably operate to close and open, it is desirable to arrange a flat voltage portion at each of the latch timings indicated with the down-pointing triangles in FIG. 5. In the first embodiment shown in FIG. 5, the flat voltage portions of the duration for ensuring stable operation of the switch 62 are not included in the description. The flat voltage portion is valuable from the viewpoint of improving the stability of the operation, but is dispensable in the implementation of the present invention.

<Relationship Between the Waveform Applied to the Pressure Generating Element and the Ejection State>

FIG. 6 is a table showing the relationship between the selection pattern of the subsidiary waveform A and the main waveform B, and the ejection state (whether a droplet is substantially ejected or not), when using the drive waveform shown in FIG. 5. As shown in FIG. 6, when a certain nozzle is designated not to eject any droplet in accordance with the image content to be printed, both the subsidiary waveform A and the main waveform B are off at the latch timings 1 and 2. Thereby, a state where no droplet is ejected from the nozzle is achieved.

When a certain nozzle is designated to eject a droplet in accordance with the image content to be printed, the subsidiary waveform A is off at the latch timing 1 and the main waveform B is on at the latch timing 2. If the corresponding switch 62 in the circuit control device 60 is normally functioning, then the control at the latch timings 1 and 2 is valid and only the main waveform B is applied to the corresponding pressure generating element 30. When only the main waveform B is independently applied while the subsidiary waveform A is off, a droplet is ejected from the corresponding nozzle.

When the above-described ejection control method is employed, the on/off control at the latch timings 1 and 2 is impossible for the pressure generating element connected to the switch that remains closing due to a fault in the circuit control device (ASIC) 60, or the like. Therefore, both the subsidiary waveform A and the main waveform B are on and the whole drive waveform is applied to the pressure generating element connected to the switch that continuously closes. In this case, no droplet is substantially ejected from the corresponding nozzle.

<Concept that "No Droplet is Substantially Ejected">

The concepts that "no droplet is substantially ejected", "no ejection is substantially to caused", and the like, in the present specification should be interpreted as meaning one of the following three states (1)-(3), depending on the use of the liquid ejection apparatus.

(1) No droplet separates from the nozzle.

(2) A droplet separates from the nozzle, but is not deposited on a recording medium (base), such as paper. For instance, this corresponds to a case where the droplet volume is extremely small so that the droplet flies off somewhere else or is removed by a ventilating fan, without reaching the base.

(3) A droplet is deposited on the base, but does not function as a recording dot. For instance, the following examples can be given.

(i) The droplet deposited on the base is very small and imperceptible to the naked eye. Due to poor ejection efficiency, the deposited droplet is so small as to be unrecognizable as a "dot".

(ii) In a case where the ejected droplets are used for material deposition, for example, to form a copper wiring pattern, the deposited droplets are so small as not to join together and not to function as a wire.

As described above, the meaning (allowable range) of the terms that "no droplet is substantially ejected", "no ejection is substantially caused", and the like, differs depending on the application of the liquid ejection apparatus.

In the case of the inkjet head printer for printing high-definition images, it is not desirable to deposit any droplet on the base (recording medium) at a pixel where no dot is to be formed according to the image information, and therefore the interpretation in (1) or (2) is adopted, and in the case of a wiring printing apparatus which forms copper wiring, where priority is given to the connected/unconnected status, it is possible to enlarge the scope of the concept to include (3) above.

Second Embodiment

Second Drive Waveform

To give a general description of the technology of the first embodiment concerning the drive waveform to be applied to the pressure generating element, when the voltage changes in the same direction are separated by (2n+1)×(Tc/2), where n is an integer not less than 0, the pressure waves caused by the voltage changes can cancel each other. FIG. 5 corresponds to a case where the waveform element a1 of the subsidiary waveform A and the waveform element b1 of the main waveform B are voltage changes having the same form, and n=0.

Figure 7:
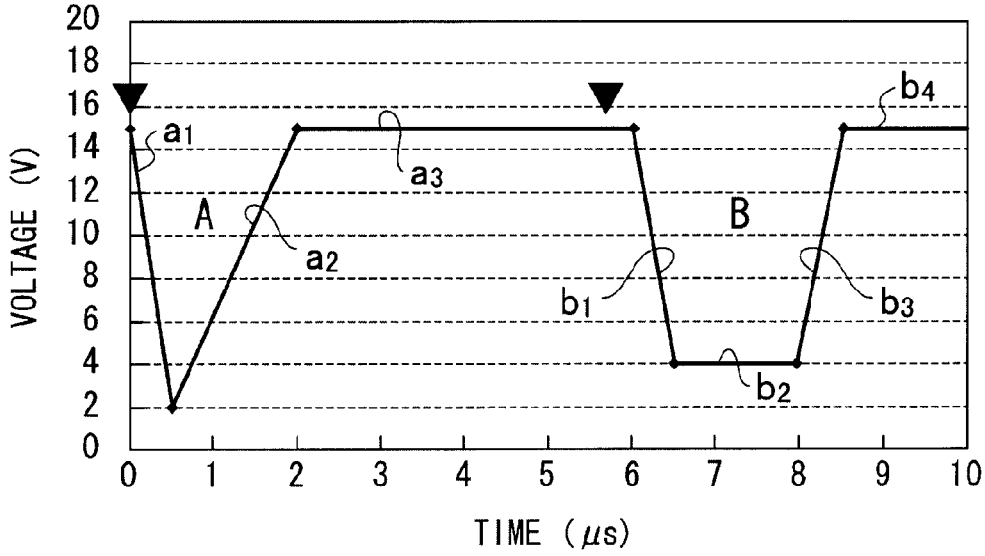
FIG. 7 is a waveform diagram of a drive waveform according to a second embodiment.

FIG. 7 shows a drive waveform according to the second embodiment. The drive waveform in FIG. 7 corresponds to a case where n=1. In FIG. 7, elements which are the same as or similar to those in FIG. 5 are denoted with the same reference numerals, and further explanation thereof is omitted here. The drive waveform in FIG. 7 includes a holding waveform element a3 where the potential holds the reference potential, subsequent to the rising waveform element a2 of the subsidiary waveform A. The falling waveform element b1 of the main waveform B is subsequent to the waveform element a3.

The time points (the values on the time axis) corresponding to the starts and ends of the waveform elements a1, a2, a3, b1, b2, b3 and b4 or the boundaries between the waveform elements are 0.0 μs, 0.5 μs, 2.0 μs, 6.0 μs, 6.5 μs, 8.0 μs, 8.5 μs and 32.1 μs.

In FIG. 7, the time interval between the falling portion (the waveform element a1) of the subsidiary waveform A and the falling portion (the waveform element b1) of the main waveform B is 6 μs (=3×(Tc/2)). By this means, the pressure wave caused by the falling portion (the waveform element a1) of the subsidiary waveform A and the pressure wave caused by the falling portion (the waveform element b1) of the main waveform B can cancel each other.

The relationship between the selection pattern of the subsidiary waveform A and the main waveform B in the drive waveform shown in FIG. 7 and the ejection state (whether a droplet is substantially ejected or not) is the same with the relationship shown in FIG. 6, and further explanation thereof is omitted here.

Third Embodiment

Third Drive Waveform

Figure 8:
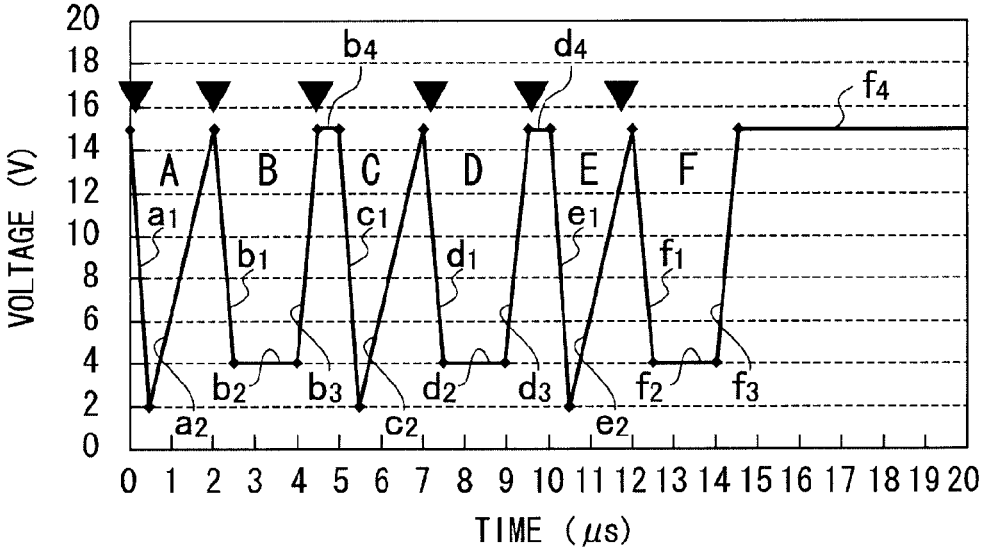
FIG. 8 is a waveform diagram of a drive waveform according to a third embodiment.

In the first embodiment shown in FIG. 5 and the second embodiment shown in FIG. 7, the main waveform is constituted of one pulse only; however, the present invention can also be applied to a multi-pulse composition as shown in FIG. 8. FIG. 8 shows a drive waveform according to the third embodiment. In FIG. 8, elements which are the same as or similar to those in FIG. 5 are denoted with the same reference numerals, and further explanation thereof is omitted here. The resonance period Tc of the pressure chamber system is taken to be 4 μs.

In the drive waveform shown in FIG. 8, each of the waveform sections A, C and E serves as the subsidiary waveform, and each of the waveform sections B, D and F serves as the main waveform.

The relationship between the subsidiary waveform A and the main waveform B in the drive waveform in FIG. 8 is similar to the drive waveform in FIG. 5. Furthermore, in the drive waveform in FIG. 8, the relationship between the subsidiary waveform C and the main waveform D and the relationship between the subsidiary waveform E and the main waveform F are also similar to the relationship between the subsidiary waveform A and the main waveform B. More specifically, the pressure wave caused by the waveform element c1 of the subsidiary waveform C and the pressure wave caused by the waveform element d1 of the main waveform D can cancel each other, and the pressure wave caused by the waveform element e1 of the subsidiary waveform E and the pressure wave caused by the waveform element f1 of the main waveform F can cancel each other.

A latch timing 3 is arranged before the pulse of the subsidiary waveform C constituted of the waveform elements c1 and c2. A latch timing 4 is arranged before the pulse of the main waveform D constituted of the waveform elements d1, d2, d3 and d4. A latch timing 5 is arranged before the pulse of the subsidiary wave E constituted of the waveform elements e1 and e2. A latch timing 6 is arranged before the pulse of the main waveform F constituted of the waveform elements f1, f2, f3 and f4. In this way, there are the latch timings 1 to 6, at which the close/open state of the switch 62 is controlled, respectively before the pulses.

The time points (the values on the time axis) corresponding to the starts and ends of the waveform elements a1, a2, b1, b2, b3, b4, c1, c2, d1, d2, d3, d4, e1, e2, f1, f2, f3 and f4 or the boundaries between the waveform elements are 0.0 μs, 0.5 μs, 2.0 μs, 2.5 μs, 4.0 μs, 4.5 μs, 5.0 μs, 5.5 μs, 7.0 μs, 7.5 μs, 9.0 μs, 9.5 μs, 10.0 μs, 10.5 μs, 12.0 μs, 12.5 μs, 14.0 μs, 14.5 μs and 32.1 μs.

The merit of using multiple pulses as shown in FIG. 8 is that it is possible to change the volume of the ejected droplet by the combination of the applied main waveforms. For example, it is possible to vary the droplet size, in such a manner that a small droplet is ejected when the main waveform B only is applied to the pressure generating element, a medium droplet is ejected when the main waveforms B and D are applied to the pressure generating element, and a large droplet is ejected when the main waveforms B, D and F are applied to the pressure generating element.

FIG. 9 is a table showing the relationship between the selection pattern of the subsidiary waveforms and the main waveforms and the ejection state (whether a droplet is substantially ejected or not, and the size of the droplet when ejected), when using the drive waveform shown in FIG. 8. When a certain nozzle is designated not to eject any droplet, all of the subsidiary waveforms A, C and E and the main waveforms B, D and F are off at all of the latch timings 1 to 6. By this means, no droplet is ejected from the nozzle.

When a certain nozzle is designated to eject a small droplet, the subsidiary waveforms A, C and E are off, the main waveform B is on, and the other main waveforms D and F are off.

When a certain nozzle is designated to eject a medium droplet, the subsidiary waveforms A, C and E are off, the main waveforms B and D are on, and the other main waveform F is off. Consequently, the main waveforms B and D are consecutively applied to the pressure generating element corresponding to the designated nozzle, and thus a dot formed of the medium droplet is recorded by the two consecutive ejection actions.

When a certain nozzle is designated to eject a large droplet, the subsidiary waveforms A, C and E are off, and all of the main waveforms B, D and F are on. Consequently, the main waveforms B, D and F are consecutively applied to the pressure generating element corresponding to the designated nozzle, and a dot formed of the large droplet is recorded by the three consecutive ejection actions.

When a switch in the circuit control device 60 breaks down and remains closing, the control at the latch timings 1 to 6 is impossible, and the whole of the drive waveform (all of the subsidiary waveforms A, C and E and the main waveforms B, D and F) is applied to the pressure generating element connected to the switch that continuously closes. In this case, no droplet is substantially ejected from the corresponding nozzle, similarly to the embodiment described with reference to FIG. 6.

In FIG. 9, the main waveforms are selected from the beginning side of the drive waveform, so that a small droplet is ejected by means of the main waveform B only, a medium droplet is ejected by means of the main waveforms B and D, and a large droplet is ejected by means of the main waveforms B, D and F; however, when changing the droplet size, the method of selecting the pulses is not limited to this. For example, it is also possible to adopt a mode in which the main waveforms are selected from the ending side of the drive waveform, in such a manner that a small droplet is ejected by means of the main waveform F only, a medium droplet is ejected by means of the main waveforms D and F, and a large droplet is ejected by means of the main waveforms B, D and F.

Fourth Embodiment

Fourth Drive Waveform

In the case where the subsidiary waveform is arranged before the main waveform as in the first to third embodiments, the subsidiary waveform is designed so as not to substantially cause ejection. In the case of the subsidiary waveform constituted of the triangular waveform as shown in FIGS. 5, 7 and 8, no ejection is substantially caused when the subsidiary waveform is independently applied to the pressure generating element 30. This is because the subsidiary waveform does not substantially cause pressure wave, due to the relationship between the pulse width of the triangular waveform and the resonance period of the pressure chamber system. It is also possible to adopt a waveform other than the triangular waveform as the waveform that does not substantially cause pressure wave.

Figure 10:
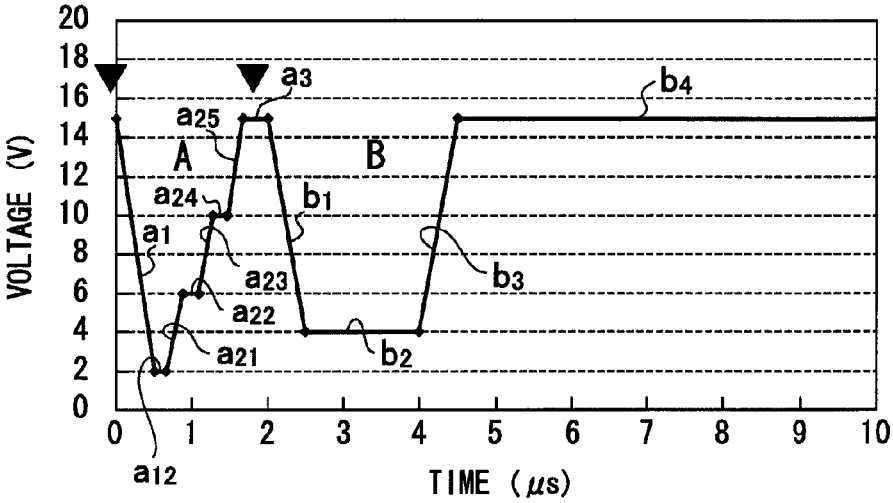
FIG. 10 is a waveform diagram of a drive waveform according to a fourth embodiment.

FIG. 10 shows a drive waveform according to the fourth embodiment. The drive waveform in FIG. 10 is composed in such a manner that the voltage rises stepwise in the rising waveform portion of the subsidiary waveform A. More specifically, the subsidiary waveform A in FIG. 10 is constituted of a falling waveform element a1, a potential holding waveform element a12, a rising waveform element a21, a potential holding waveform element a22, a rising waveform element a23, a potential holding waveform element a24, a rising waveform element a25 and a potential holding waveform element a3. The composition of the main waveform B is similar to the embodiment in FIG. 5. The time points (the values on the time axis) corresponding to the starts and ends of the waveform elements a1, a12, a22, a23, a24, a25, a3, b1, b2, b3 and b4 or the boundaries between the waveform elements are 0.0 μs, 0.5 μs, 0.7 μs, 0.9 μs, 1.1 μs, 1.3 μs, 1.7 μs, 2.0 μs, 2.5 μs, 4.0 μs, 4.5 μs and 32.1 μs.

The rising waveform portion constituted of the waveform elements a21 to a25 is designed to raise the voltage stepwise, so as to decline the ejection efficiency. Therefore, no ejection is substantially caused when the subsidiary waveform A is independently applied to the pressure generating element.

The time interval between the falling portion (the waveform element a1) of the subsidiary waveform A and the falling portion (the waveform element b1) of the subsidiary waveform B is an odd multiple of the half resonance period (Tc/2), and when both the subsidiary waveform A and the main waveform B are applied to the pressure generating element, the caused pressure waves effectively cancel each other. In FIG. 10, the waveform element a1 and the waveform element b1 are separated by 2 μs for the liquid ejection head having the pressure chamber system of the resonance period Tc=4 μs. Therefore, when the whole of the drive waveform in FIG. 10 is applied to the pressure generating element, no droplet is substantially ejected from the corresponding nozzle.

The relationship between the selection pattern of the subsidiary waveform A and the main waveform B in the drive waveform shown in FIG. 10 and the ejection state (whether a droplet is substantially ejected or not) is the same with the relationship shown in FIG. 6, and further explanation thereof is omitted here.

Fifth Embodiment

Fifth Drive Waveform

Figure 11:
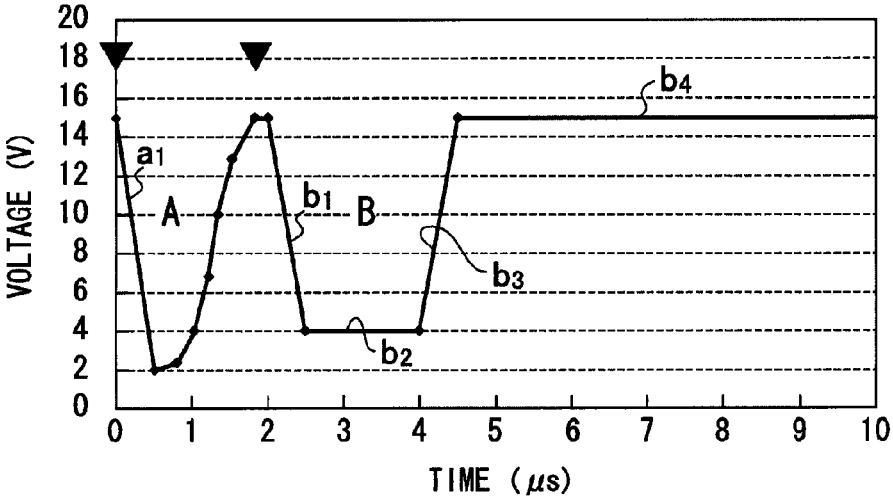
FIG. 11 is a waveform diagram of a drive waveform according to a fifth embodiment.

FIG. 11 shows a drive waveform according to the fifth embodiment. In FIG. 11, the elements which are the same as those in FIG. 10 are denoted with the same reference numerals. The drive waveform in FIG. 11 is composed in such a manner that the rising portion of the subsidiary waveform A draws an S curve. This composition of the subsidiary waveform is also possible to reduce the pressure wave generation efficiency. Therefore, no ejection is substantially caused when the subsidiary waveform A is independently applied to the pressure generating element.

The time interval between the falling portion (the waveform element a1) of the subsidiary waveform A and the falling portion (the waveform element b1) of the subsidiary waveform B is an odd multiple of the half resonance period (Tc/2), and when both the subsidiary waveform A and the main waveform B are applied to the pressure generating element, the caused pressure waves effectively cancel each other. In FIG. 11, the waveform element a1 and the waveform element b1 are separated by 2 μs for the liquid ejection head having the pressure chamber system of the resonance period Tc=4 μs. Therefore, when the whole of the drive waveform in FIG. 11 is applied to the pressure generating element, no droplet is substantially ejected from the corresponding nozzle.

Sixth Embodiment

Sixth Drive Waveform

Figure 12:
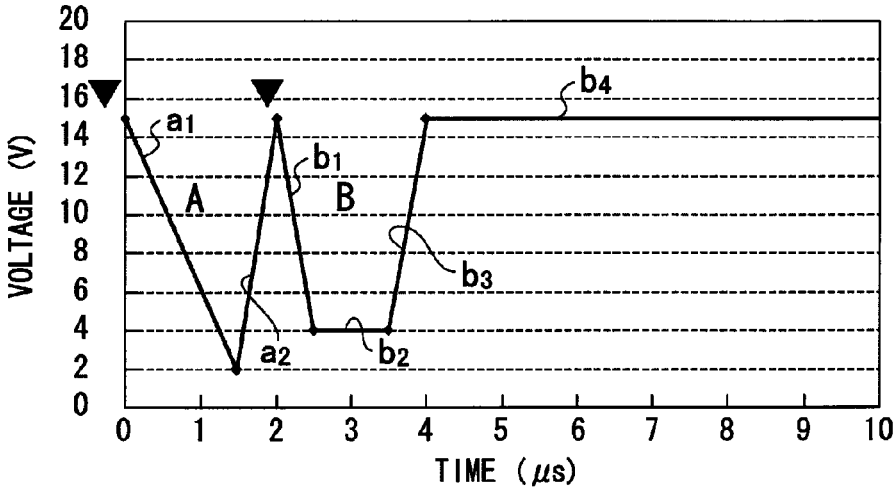
FIG. 12 is a waveform diagram of a drive waveform according to a sixth embodiment.

FIG. 12 shows a drive waveform according to the sixth embodiment. The drive waveform in FIG. 12 is designed in such a manner that the pressure wave caused by the rising portion (the waveform element a2) of the subsidiary waveform A and the pressure wave caused by the rising portion (the waveform element b3) of the main waveform B can cancel each other. The resonance period Tc of the pressure chamber system is taken to be 4 μs.

The subsidiary waveform A in FIG. 12 is a triangular waveform constituted of the waveform elements a1 and a2, and the main waveform B subsequent to the subsidiary waveform A is a trapezoidal waveform constituted of the waveform elements b1, b2, b3 and b4. In FIG. 12, the time points (the values on the time axis) corresponding to the starts and ends of the waveform elements a1, a2, b1, b2, b3 and b4 or the boundaries between the waveform elements are 0.0 μs, 1.5 μs, 2.0 μs, 2.5 μs, 3.5 μs, 4.0 μs and 32.1 μs.

The time interval between the rising portion (the waveform element a2) of the subsidiary waveform A and the rising portion (the waveform element b3) of the subsidiary waveform B is an odd multiple of the half resonance period (Tc/2), and when both the subsidiary waveform A and the main waveform B are applied to the pressure generating element, the caused pressure waves effectively cancel each other. In FIG. 12, the waveform element a2 and the waveform element b3 are separated by 2 μs for the liquid ejection head having the pressure chamber system of the resonance period Tc=4 μs. Therefore, when the whole of the drive waveform in FIG. 12 is applied to the pressure generating element, no droplet is substantially ejected from the corresponding nozzle.

The relationship between the selection pattern of the subsidiary waveform A and the main waveform B in the drive waveform shown in FIG. 12 and the ejection state (whether a droplet is substantially ejected or not) is the same with the relationship shown in FIG. 6, and further explanation thereof is omitted here.

Seventh Embodiment

Seventh Drive Waveform

Figure 13:
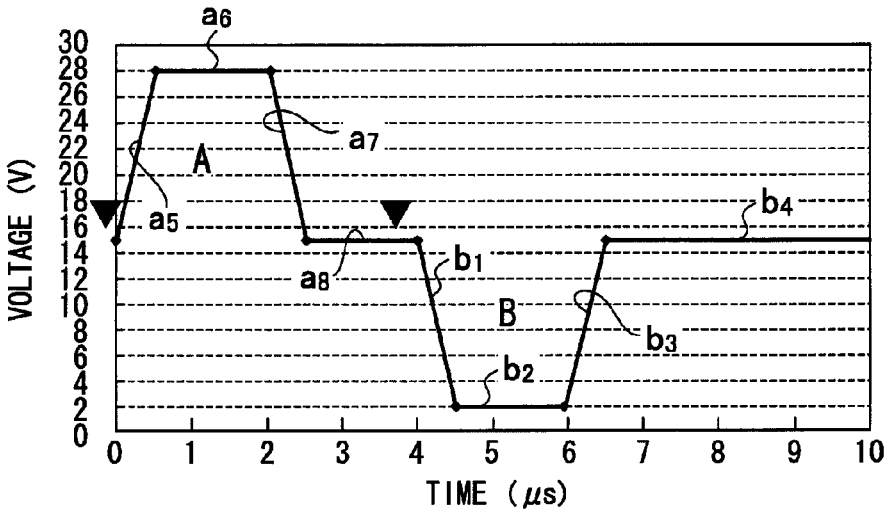
FIG. 13 is a waveform diagram of a drive waveform according to a seventh embodiment.

FIG. 13 shows a drive waveform according to the seventh embodiment. The drive waveform in FIG. 13 is designed in such a manner that the voltage change in the pulse of the subsidiary waveform A is opposite to the voltage change in the pulse of the main waveform B, and the subsidiary waveform A is arranged before the main waveform B by the resonance period Tc of the pressure chamber system, which is taken to be 4 μs.

The subsidiary waveform A in FIG. 13 is constituted of a rising waveform element a5, a holding waveform element a6 subsequent to the waveform element a5, a falling waveform element a7 subsequent to the waveform element a6, and a holding waveform element a8 subsequent to the waveform element a7. The potential rises from the reference potential Vref (=15 V) to a potential Va (=28 V) in the rising waveform element a5, then holds the potential Va (=28 V) in the holding waveform element a6, then falls from the potential Va (=28 V) to the reference potential Vref (=15 V) in the falling waveform element a7, and then holds the reference potential Vref (=15 V) in the holding waveform element a8.

The main waveform B in FIG. 13 is constituted of a falling waveform element b1 subsequent to the waveform element a8, a holding waveform element b2 subsequent to the waveform element b1, a rising waveform element b3 subsequent to the waveform element b2, and a holding waveform element b4 subsequent to the waveform element b3. The potential falls from the reference potential Vref (=15 V) to a potential Vb (=2 V) in the falling waveform element b1, then holds the potential Vb (=2 V) in the holding waveform element b2, then rises from the potential Vb to the reference potential Vref (=15 V) in the rising waveform element b3, and then holds the reference potential Vref (=15 V) in the holding waveform element b4.

In FIG. 13, the time points (the values on the time axis) corresponding to the starts and ends of the waveform elements a5, a6, a7, a8, b1, b2, b3 and b4 or the boundaries between the waveform elements are 0.0 μs, 0.5 μs, 2.0 μs, 2.5 μs, 4.0 μs, 4.5 μs, 6.0 μs, 6.5 μs and 32.1 μs.

According to the drive waveform in FIG. 13, the pressure wave caused by the subsidiary waveform A and the pressure wave caused by the main waveform B can cancel each other.

The time interval between the rising portion (the waveform element a5) of the subsidiary waveform A and the falling portion (the waveform element b1) of the main waveform B is equal to the resonance period Tc. The time interval between the falling portion (the waveform element a7) of the subsidiary waveform A and the rising portion (the waveform element b3) of the main waveform B is also equal to the resonance period Tc. Since the rising and falling waveform elements of the subsidiary waveform A and the falling and rising waveform elements of the main waveform B are separated by Tc, then the pressure wave caused by the subsidiary waveform A and the pressure wave caused by the main waveform B can cancel each other. Consequently, when the subsidiary waveform A and the main waveform B are consecutively applied (i.e., when the whole of the drive waveform in FIG. 13 is applied) to the pressure generating element, no droplet is substantially ejected from the corresponding nozzle.

When the push waveform as the subsidiary waveform A (the waveform element a5) in FIG. 13 alone is applied to the pressure generating element, no pressure wave required for ejection is efficiently generated in the ink in the pressure chamber, and no droplet of the ink is substantially ejected from the corresponding nozzle.

To give a general description of the technology of the seventh embodiment concerning the drive waveform to be applied to the pressure generating element, the waveform elements of the voltage changes in the mutually opposite directions, such as the rising voltage portion of the subsidiary waveform and the falling voltage portion of the main waveform, or the falling voltage portion of the subsidiary waveform and the rising voltage portion of the main waveform, are separated from each other by a natural number multiple of Tc. More specifically, the drive waveform has the waveform elements that produce the voltage changes in the opposite directions are applied at a time interval of $(n+1)\times Tc$ apart, where n is an integer not less than 0. By adopting this waveform composition, the pressure waves caused by the application of these waveform elements can cancel each other.

In FIG. 13, the voltage amplitude of the subsidiary waveform A ($|Va-Vref|=13$ V) is equal to the voltage amplitude of the main waveform B ($|Vref-Vb|=13$ V); however, the voltage amplitude of the subsidiary waveform A and the voltage amplitude of the main waveform B can have different values.

As described with reference to FIG. 5, the subsidiary waveform A preceding the main waveform B is required not to substantially cause ejection when the subsidiary waveform is applied to the pressure generating element 30, as well as suppressing ejection to be caused by the application of the following main waveform B (i.e., cancelling the pressure wave caused by the following main waveform B). The actual waveform can adopt various designs, and it is desirable that the voltage amplitude of the subsidiary waveform A is not lower than the voltage amplitude of the main waveform B.

Eighth Embodiment

Eighth Drive Waveform

Figures 14, 15:
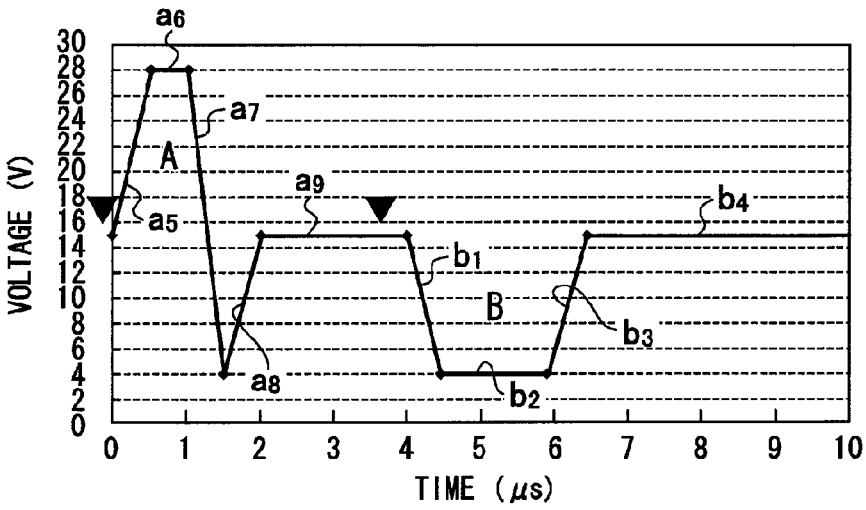
FIG. 14 is a waveform diagram of a drive waveform according to an eighth embodiment.
FIG. 15 is a table showing the relationship between a selection pattern of a subsidiary waveform and a main waveform when using the drive waveform in FIG. 14, and an ejection state (whether a droplet is substantially ejected or not)

FIG. 14 shows a drive waveform according to the eighth embodiment. In the drive waveform shown in FIG. 14, the main waveform B is preceded by the subsidiary waveform A that is constituted of a rising waveform element a5, a holding waveform element a6 subsequent to the waveform element a5, a falling waveform element a7 subsequent to the waveform element a6, a rising waveform element a8 subsequent to the waveform element a7, and a holding waveform element a9 subsequent to the waveform element a8. The potential rises from the reference potential Vref (=15 V) to a potential Va (=28 V) in the rising waveform element a5, then holds the potential Va (=28 V) in the holding waveform element a6, then falls from the potential Va (=28 V) to a potential Va2 (=4 V) in the falling waveform element a7, then rises from the potential Va2 (=4 V) to the reference potential Vref (=15 V) in the rising waveform element a8, and then holds the reference potential Vref (=15 V) in the holding waveform element a9.

The main waveform B in FIG. 14 is constituted of a falling waveform element b1 subsequent to the waveform element a9, a holding waveform element b2 subsequent to the waveform element b1, a rising waveform element b3 subsequent to the waveform element b2, and a holding waveform element b4 subsequent to the waveform element b3. The potential falls from the reference potential Vref (=15 V) to a potential Vb (=2 V) in the falling waveform element b1, then holds the potential Vb (=2 V) in the holding waveform element b2, then rises from the potential Vb to the reference potential Vref (=15 V) in the rising waveform element b3, and then holds the reference potential Vref (=15 V) in the holding waveform element b4.

In FIG. 14, the time points (the values on the time axis) corresponding to the starts and ends of the waveform elements a5, a6, a7, a8, a9, b1, b2, b3 and b4 or the boundaries between the waveform elements are 0.0 μs, 0.5 μs, 1.5 μs, 2.0 μs, 2.5 μs, 4.0 μs, 4.5 μs, 6.0 μs, 6.5 μs and 32.1 μs.

When this drive waveform is applied to the pressure generating element, the pulling portion of the subsidiary waveform A (the drive waveform portion that causes the voltage to suddenly fall from 28 V to 4 V in the waveform element a7 and thereby causes the corresponding pressure chamber to suddenly expand) causes the meniscus of the liquid formed in the corresponding nozzle to be sharply pulled toward the pressure chamber, and the meniscus is thereby broken. Thus, an air bubble is drawn into the nozzle. Therefore, even when the main waveform B is applied subsequently to the subsidiary waveform A to the pressure generating element, no droplet can be substantially ejected from the nozzle.

FIG. 15 is a table showing the relationship between the selection pattern of the subsidiary waveform A and the main waveform B, and the ejection state (whether a droplet is substantially ejected or not), when using the drive waveform shown in FIG. 14. As shown in FIG. 15, when a certain nozzle is designated not to eject any droplet in accordance with the image content to be printed, both the subsidiary waveform A and the main waveform B are off at the latch timings 1 and 2. Thereby, a state where no droplet is ejected from the nozzle is achieved.

When a certain nozzle is designated to eject a droplet in accordance with the image content to be printed, the subsidiary waveform A is off at the latch timing 1 and the main waveform B is on at the latch timing 2. Thus, only the main waveform B is applied to the corresponding pressure generating element. When only the main waveform B is independently applied while the subsidiary waveform A is off, a droplet is ejected from the corresponding nozzle.

When a switch in the circuit control device 60 breaks down and remains closing, the control at the latch timings 1 and 2 is impossible, and the whole of the drive waveform (the subsidiary waveform A and the main waveform B) is applied to the pressure generating element connected to the switch that continuously closes. In this case, since the main waveform B is subsequently applied after the preceding application of the subsidiary waveform A has caused an air bubble to be drawn inside the corresponding nozzle, then no droplet is substantially ejected from the nozzle.

Combination of Embodiments

It is possible to suitably combine the technologies described in the first to eighth embodiments, as necessary. For instance, it is possible to modify the rising voltage portion of the subsidiary waveform in the drive waveform in FIG. 7, 8 or 12 as to the rising voltage portion of the subsidiary waveform in the drive waveform in FIG. 10 or 11. Moreover, it is also possible to join together some combinations of the subsidiary waveform and the main waveform shown in FIG. 12, 13 or 14, as illustrated in FIG. 8.

Composition of Inkjet Recording Apparatus

Figure 16:
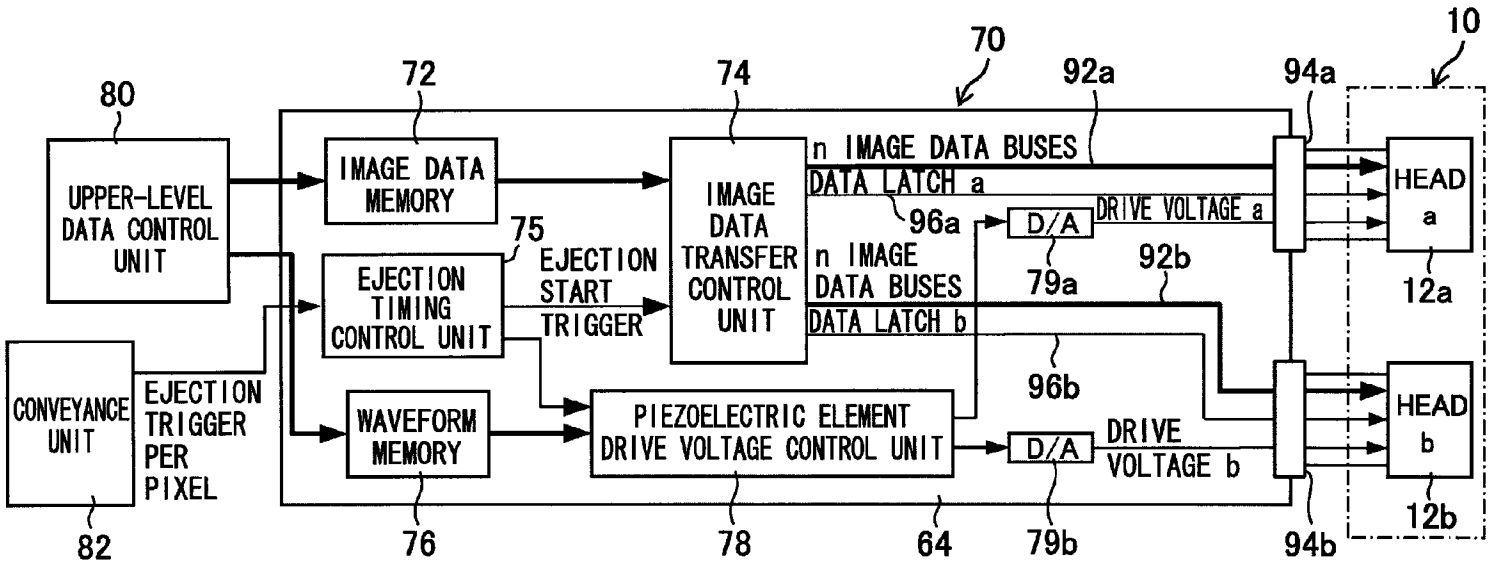
FIG. 16 is a block diagram of the composition of an inkjet recording apparatus according to an embodiment of the present invention.

FIG. 16 is a block diagram showing the composition of an inkjet recording apparatus which employs the drive devise for the liquid ejection head according to an embodiment of the present invention. The inkjet head 10 is constituted of head modules 12*a* and 12*b*. Although the two head modules 12*a* and 12*b* are depicted in order to simplify the description here, there is no particular restriction on the number of head modules which constitute one print head.

The nozzles (22 in FIG. 1) are arranged at high density in a two-dimensional configuration on the ink ejection faces of the head modules 12*a* and 12*b*. The pressure generating elements (30 in FIG. 1) corresponding to the respective nozzles are arranged in the head modules 12*a* and 12*b*. The circuit control device 60 shown in FIG. 2 is installed in each of the head modules 12*a* and 12*b*.

By arranging and joining together the head modules 12*a* and 12*b* in the widthwise direction of the paper (not shown) serving as an image formation medium, a long line head (a page-wide head capable of single-pass printing) which has a nozzle row capable of image formation at a prescribed recording resolution (for example, 1200 dpi) through the whole recording range in the paper width direction (the whole possible image formation region) is composed.

The head control unit 70 (serving as the drive device for the liquid ejection head) connected to the inkjet head 10 functions as the control device for controlling the driving of the piezoelectric elements corresponding to the respective nozzles of the head modules 12*a* and 12*b*, so as to control the ink ejection operation (whether or not to perform ejection, a volume of droplet to be ejected, and the like) from the nozzles.

The head control unit 70 includes an image data memory 72, an image data transfer control unit 74, an ejection timing control unit 75, a waveform memory 76, a drive voltage control unit 78, and D/A converters 79*a* and 79*b*. In the present embodiment, the image data transfer control unit 74 includes a latch signal transfer circuit, and a data latch signal is applied at a suitable timing to the head modules 12*a* and 12*b* from the image data transfer control unit 74.

The image data memory 72 stores image data which has been developed into image data for printing (dot data). The waveform memory 76 stores digital data indicating voltage waveforms of drive signals (drive waveforms) for driving the piezoelectric elements. For example, the waveform memory 76 stores data of the drive waveforms illustrated in FIGS. 5, 7, 8 and 10 to 14, and data indicating pulse divisions, and the like. An upper-level data control unit 80 (serving as the upper-level control device) manages the image data inputted to the image data memory 72 and the waveform data inputted to the waveform memory 76. The upper-level data control unit 80 can be constituted of a personal computer, a host computer, or the like. The head control unit 70 includes a USB (Universal Serial Bus) or other communication interface as a data communication device for receiving data from the upper-level data control unit 80.

Only one inkjet head 10 (for one color) is depicted in FIG. 16 in order to simplify the drawing; however, in the case of an inkjet recording apparatus including a plurality of inkjet heads for inks of a plurality of colors, a plurality of head control units 70 are independently arranged (in head units) respectively to the inkjet heads 10 of the colors. For example, in a composition including the color-separate print heads corresponding to four colors of cyan (C), magenta (M), yellow (Y) and black (K), the head control units 70 are arranged respectively for the inkjet heads of the colors C, M, Y and K, and one upper-level data control unit 80 manages the head control units 70 of the respective colors.

When the system is started up, the waveform data and the image data are transferred from the upper-level control unit 80 to the head control units 70 of the respective colors. Data transfer of the image data can be carried out in synchronism with the paper conveyance during the execution of printing. During a printing operation, the ejection timing control units 75 of the respective colors receive an ejection trigger signal from the paper conveyance unit 82, and then output a start trigger for starting an ejection operation, to the image data transfer control unit 74 and the drive voltage control unit 78. Upon receiving this start trigger, the image data transfer control unit 74 and the drive voltage control unit 78 transfer the waveform data and the image data at the recording resolution to the head modules 12*a* and 12*b*, and thereby cause a selected ejection operation (ejection drive control of a drop-on-demand type) corresponding to the image data to be carried out so as to achieve page-wide printing.

By outputting the drive voltage waveform data from the drive voltage control unit 78 to the D/A converters 79*a* and 79*b* in accordance with the print timing signal (ejection trigger signal) inputted from an external source, the waveform data is converted to analog voltage waveforms by the D/A converters 79*a* and 79*b*. The waveforms (analog voltage waveforms) outputted from the D/A converters 79*a* and 79*b* are amplified by a power amplifier circuit (not shown) to power signals of prescribed currents and voltages suited to driving the piezoelectric elements, and the power signals are supplied to the head modules 12*a* and 12*b*.

The image data transfer control unit 74 can be constituted of a CPU (Central Processing Unit) and/or an FPGA (Field Programmable Gate Array). The image data transfer control unit 74 carries out control for transferring the nozzle control data for the head modules 12*a* and 12*b* (here, the image data corresponding to a dot arrangement at the recording resolution) to the head modules 12*a* and 12*b*, on the basis of the data stored in the image data memory 72. The nozzle control data is image data (dot data) which determines the on (being caused to eject a droplet) and off (not being caused to eject any droplet) of the nozzles in the head modules 12*a* and 12*b*. The image data transfer control unit 74 transfers the nozzle control data to the head modules 12*a* and 12*b*, and thereby controls the closing and opening (on/off switching) of each of the switches connected to the pressure generating elements corresponding to the nozzles.

Each of image data transfer paths 92*a* and 92*b* for transferring the nozzle control data outputted from the image data transfer control unit 74 to the head modules 12*a* and 12*b* is constituted of a plurality of signal wires (i.e., n wires, where n≥2). Ends of the respective data transfer paths (data buses) 92*a* and 92*b* are connected to the output terminals of the image data transfer control unit 74 (e.g., pins of the integrated circuit), and the other ends are connected to the head modules 12*a* and 12*b* through connectors 94*a* and 94*b* corresponding to the head modules 12*a* and 12*b*.

The data buses 92*a* and 92*b* can be constituted of copper wire patterns formed on the electronic circuit board (corresponding to the inkjet head control circuit board 64 in FIG. 2) on which the image data transfer control unit 74, the drive voltage control unit 78, and the like, are mounted, or the data buses 92*a* and 92*b* can be constituted of wire harnesses, or of a combination of these.

The head modules 12*a* and 12*b* are connected respectively to signal wires 96*a* and 96*b* of the data latch signals corresponding to the head modules 12*a* and 12*b*. The data latch signals are sent from the image data transfer control unit 74 to the head modules 12*a* and 12*b* at the required timings, in order that the data signals transferred through the data buses 92*a* and 92*b* are set as nozzle data for the head modules 12*a* and 12*b*. When a certain volume of image data has been transferred from the image data transfer control unit 74 to the head modules 12*a* and 12*b* through the image data buses 92*a* and 92*b*, then the image data transfer control unit 74 sends the signal serving as the data latch signal to the head modules 12*a* and 12*b*. The data about the on/off switching of displacement of the piezoelectric elements in the head modules 12*a* and 12*b* is established at the timing of the data latch signal. Thereupon, the drive voltages a and b are applied respectively to the head modules 12*a* and 12*b*, thereby the piezoelectric elements relating to the "on" setting are slightly displaced, and ink droplets are ejected accordingly.

By depositing the thus ejected ink droplets onto paper, printing at a desired resolution (1200 dpi, for instance) is performed. The piezoelectric elements which have been set to "off" do not produce displacement and do not cause ejection of droplets, even when a drive voltage is applied to the head modules.

A combination of the waveform memory 76, the drive voltage control unit 78, and the D/A converters 79*a* and 79*b* serves as the "voltage waveform generating device".

Figure 17:
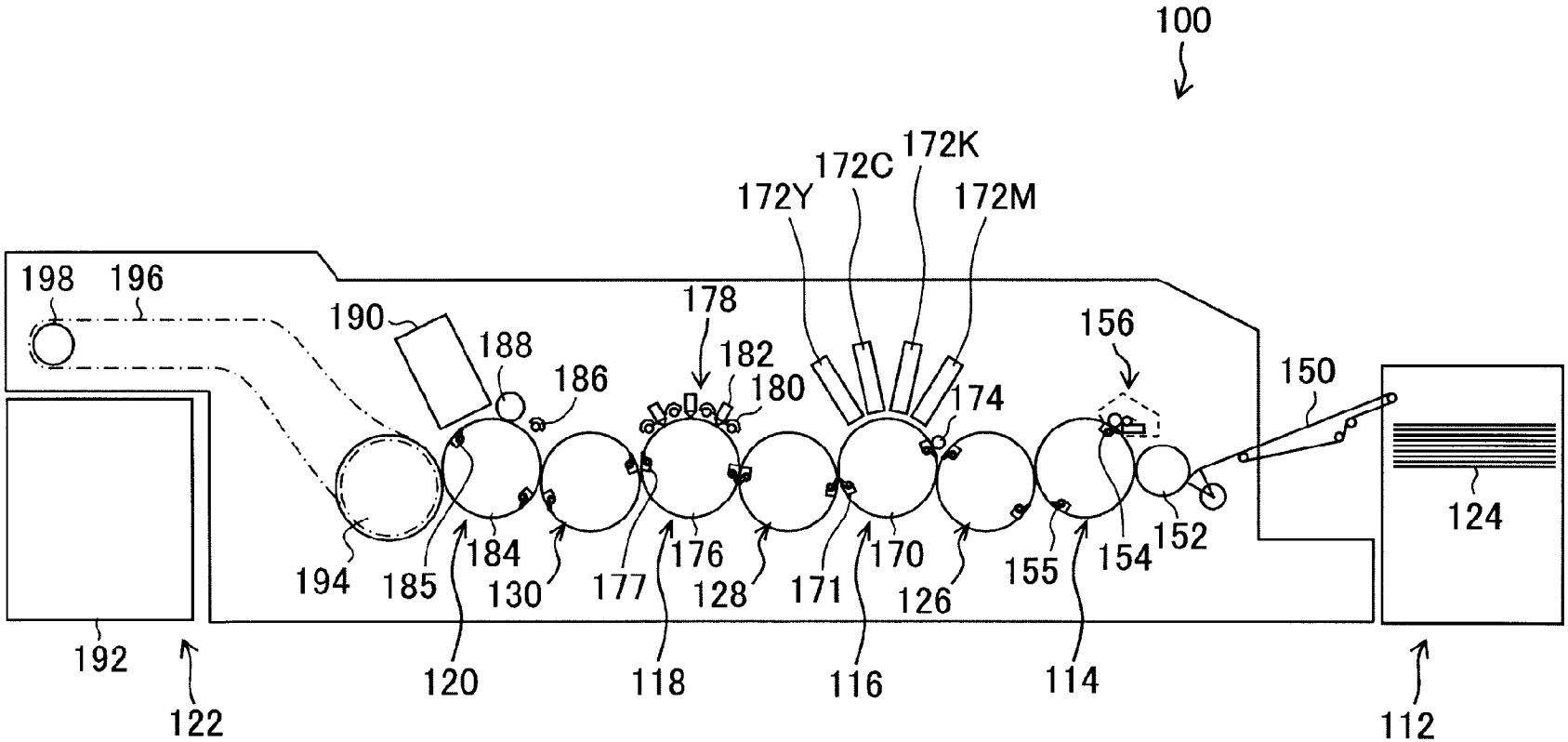
FIG. 17 is a general schematic drawing of the inkjet recording apparatus according to the embodiment of the present invention.

FIG. 17 is a general schematic drawing showing the composition of an inkjet recording apparatus according to an embodiment of the present invention. The inkjet recording apparatus 100 in the present embodiment includes a paper supply unit 112, a treatment liquid deposition unit 114, an image formation unit 116, a drying unit 118, a fixing unit 120 and a paper output unit 122. The inkjet recording apparatus 100 is a single-pass inkjet recording apparatus, which forms a desired color image by ejecting and depositing droplets of inks of a plurality of colors from inkjet heads 172M, 172K, 172C and 172Y onto a recording medium 124 (corresponding to an "image formation medium", also referred to as "paper" for the sake of convenience) held on an image formation drum 170 of an image formation unit 116. The inkjet recording apparatus 100 is an image forming apparatus of a drop on-demand type employing a two-liquid reaction (aggregation) method in which an image is formed on the recording medium 124 by depositing a treatment liquid (here, an aggregating treatment liquid) on the recording medium 124 before depositing droplets of ink, and causing the treatment liquid and the ink to react each other.

<Paper Supply Unit>

Cut sheets of the recording medium 124 are stacked in the paper supply unit 112, and the recording medium 124 is supplied, one sheet at a time, from a paper supply tray 150 of the paper supply unit 112 to the treatment liquid deposition unit 114. In the present embodiment, cut sheet paper (cut paper) is used as the recording medium 124; however, it is also possible to adopt a composition in which paper is supplied from a continuous roll (rolled paper) and is cut to the required size.

<Treatment Liquid Deposition Unit>

The treatment liquid deposition unit 114 is a mechanism which deposits the treatment liquid onto a recording surface of the recording medium 124. The treatment liquid includes a coloring material aggregating agent, which aggregates the coloring material (in the present embodiment, the pigment) in the ink deposited by the image formation unit 116, and the separation of the ink into the coloring material and the solvent is promoted due to the treatment liquid and the ink making contact with each other.

The treatment liquid deposition unit 114 includes a paper supply drum 152, a treatment liquid drum (also referred to as "pre-coating drum") 154 and a treatment liquid application device 156. The treatment liquid drum 154 holds and conveys the recording medium 124 so as to rotate. The treatment liquid drum 154 has a hook-shaped gripping device (gripper) 155 arranged on the outer circumferential surface thereof, and is devised in such a manner that the leading end of the recording medium 124 can be held by gripping the recording medium 124 between the hook of the holding device 155 and the circumferential surface of the treatment liquid drum 154. The treatment liquid drum 154 can have suction holes arranged in the outer circumferential surface thereof, and be connected to a suction device which performs suction through the suction holes. By this means, it is possible to hold the recording medium 124 tightly against the circumferential surface of the treatment liquid drum 154.

The treatment liquid application device 156 includes a treatment liquid vessel, in which the treatment liquid is stored, an anilox roller (metering roller), which is partially immersed in the treatment liquid in the treatment liquid vessel, and a rubber roller, which transfers a dosed amount of the treatment liquid to the recording medium 124, by being pressed against the anilox roller and the recording medium 124 on the treatment liquid drum 154. In the present embodiment, a composition is described which uses the roller-based application method; however, the method is not limited to this, and it is also possible to employ various other methods, such as a spray method, an inkjet method, or the like.

The recording medium 124 onto which the treatment liquid has been deposited by the treatment liquid deposition unit 114 is transferred from the treatment liquid drum 154 to the image formation drum 170 of the image formation unit 116 through an intermediate conveyance unit 126.

<Image Formation Unit>

The image formation unit 116 includes the image formation drum (also referred to as a "jetting drum") 170, a paper pressing roller 174, and the inkjet heads 172M, 172K, 172C and 172Y. The composition of the inkjet head 10 shown in FIG. 1 is employed as each of the inkjet heads 172M, 172K, 172C and 172Y of the respective colors, and the composition of the head control unit 70 shown in FIG. 16 is employed as each of the control devices for the inkjet heads 172M, 172K, 172C and 172Y.

Similarly to the treatment liquid drum 154, the image formation drum 170 has a hook-shaped holding device (gripper) 171 arranged on the outer circumferential surface thereof. A plurality of suction holes (not shown) are formed in a prescribed pattern in the circumferential surface of the image formation drum 170, and the recording medium 124 is held by suction on the circumferential surface of the image formation drum 170 by air suction through the suction holes. The composition is not limited to one which holds the recording medium 124 by means of negative pressure suction, and it is also possible to adopt a composition which holds the recording medium 124 by means of electrostatic attraction, for example.

Each of the inkjet heads 172M, 172K, 172C and 172Y is a full-line type inkjet recording head having a length corresponding to the maximum width of the image forming region on the recording medium 124, and rows of nozzles (two-dimensionally arranged nozzles) for ejecting droplets of the ink arranged throughout the whole width of the image forming region are formed in the ink ejection surface of each head. The inkjet heads 172M, 172K, 172Y and 172Y are disposed so as to extend in a direction perpendicular to the conveyance direction of the recording medium 124 (the direction of rotation of the image formation drum 170).

Cassettes of the corresponding color inks (ink cartridges) are installed respectively on the inkjet heads 172M, 172K, 172C and 172Y. Droplets of the respective inks are ejected from the inkjet heads 172M, 172K, 172C and 172Y toward the recording surface of the recording medium 124 that is held on the outer circumferential surface of the image formation drum 170.

Thus, the ejected ink makes contact with the treatment liquid that has previously been deposited on the recording surface, and the coloring material (pigment) dispersed in the ink is aggregated to form a coloring material aggregate. As one possible example of a reaction between the ink and the treatment liquid, in the present embodiment, acid contained in the treatment liquid lowers the pH of the ink and breaks down the dispersion of pigment in the ink so as to cause the pigment to aggregate, and thereby bleeding of the coloring material, intermixing between the inks of different colors, and interference between deposited droplets due to combination of the ink droplets upon landing are avoided. Thus, flowing of coloring material, and the like, on the recording medium 124 is prevented and an image is formed on the recording surface of the recording medium 124.

The droplet ejection timings of the inkjet heads 172M, 172K, 172C and 172Y are controlled with an encoder 294 (not shown in FIG. 17, and shown in FIG. 18) that is arranged on the image formation drum 170 to determine the speed of rotation. An ejection trigger signal (pixel trigger) is issued on the basis of the encoder determination signal. By this means, it is possible to specify the deposition positions of the ejected droplets with high accuracy. Moreover, speed variations caused by inaccuracies in the image formation drum 170, or the like, can be ascertained in advance, and the droplet ejection timings on the basis of the encoder can be corrected, thereby reducing droplet deposition non-uniformities, irrespectively of inaccuracies in the image formation drum 170, the accuracy of the rotational axle, and the speed of the outer circumferential surface of the image formation drum 170. Furthermore, maintenance operations such as cleaning the nozzle surfaces of the inkjet heads 172M, 172K, 172C and 172Y, ejecting ink of increased viscosity, and the like, can be carried out with the head units withdrawn from the image formation drum 170.

Although the configuration with the CMYK standard four colors is described in the present embodiment, combinations of the ink colors and the number of colors are not limited to those. As required, light inks, dark inks and/or special color inks can be added. For example, a configuration in which inkjet heads for ejecting light-colored inks such as light cyan and light magenta are added is possible. Moreover, there are no particular restrictions of the sequence in which the heads of respective colors are arranged. The recording medium 124 onto which the image has been formed in the image formation unit 116 is transferred from the image formation drum 170 to a drying drum 176 of the drying unit 118 through an intermediate conveyance unit 128.

<Drying Unit>

The drying unit 118 is a mechanism which dries the water content contained in the solvent that has been separated by the action of aggregating the coloring material. The drying unit 118 includes the drying drum 176 and a solvent drying device 178. Similarly to the treatment liquid drum 154, the drying drum 176 has a hook-shaped holding device (gripper) 177 arranged on the outer circumferential surface thereof, in such a manner that the leading end of the recording medium 124 can be held by the holding device 177.

The solvent drying device 178 is disposed in a position opposing the outer circumferential surface of the drying drum 176, and is constituted of a plurality of halogen heaters 180 and hot air spraying nozzles 182 disposed respectively between the halogen heaters 180. It is possible to achieve various drying conditions, by suitably adjusting the temperature and air flow volume of the hot air flow that is blown from the hot air flow spraying nozzles 182 toward the recording medium 124, and the temperatures of the respective halogen heaters 180. The recording medium 124 on which the drying process has been carried out in the drying unit 118 is transferred from the drying drum 176 to a fixing drum 184 of the fixing unit 120 through an intermediate conveyance unit 130.

<Fixing Unit>

The fixing unit 120 is constituted of the fixing drum 184, a halogen heater 186, a fixing roller 188 and an in-line sensor 190. Similarly to the treatment liquid drum 154, the fixing drum 184 has a hook-shaped holding device (gripper) 185 arranged on the outer circumferential surface thereof, in such a manner that the leading end of the recording medium 124 can be held by the holding device 185.

By means of the rotation of the fixing drum 184, the recording medium 124 is conveyed with the recording surface facing to the outer side, and preliminary heating by the halogen heater 186, a fixing process by the fixing roller 188 and inspection by the in-line sensor 190 are carried out in respect of the recording surface.

The fixing roller 188 is a roller member which is composed so as to heat and press the recording medium 124 in order to apply heat and pressure to the dried ink to cause self-dispersing polymer particles contained in the ink to melt and form a film. The recording medium 124 is placed between the fixing roller 188 and the fixing drum 184, and is nipped with a prescribed nip pressure (for example, 0.15 MPa), whereby a fixing process is carried out.

The fixing roller 188 is constituted of a heating roller formed of a metal pipe of aluminum, or the like, having high thermal conductivity, which internally incorporates a halogen lamp, and is controlled to a prescribed temperature (for example, 60° C. to 80° C.). By heating the recording medium 124 by means of the heating roller, thermal energy for achieving the temperature not lower than the Tg temperature (glass transition temperature) of the latex contained in the ink is applied and the latex particles are thereby caused to melt. Thereby, the fixing is performed by pressing the latex particles into the undulations in the recording medium 124, as well as leveling the undulations in the image surface and obtaining a glossy finish.

The in-line sensor 190 is a reading device for determining an ejection failure checking pattern, the density, and a defect in an image (including a test pattern) recorded on the recording medium 124, and a CCD line sensor or the like can be employed for the in-line sensor 190.

According to the fixing unit 120 having the composition described above, the latex particles in the image layer film formed by the drying unit 118 are heated, pressed and melted by the fixing roller 188, and thereby the image layer can be fixed to the recording medium 124.

Instead of the ink that contains a high-boiling-point solvent and polymer particles (thermoplastic resin particles), it is also possible to use an ink containing a monomer that can be polymerized and cured by exposure to ultraviolet (UV) light. In this case, the inkjet recording apparatus 100 includes a UV exposure unit for exposing the ink on the recording medium 124 to UV light, instead of the heat and pressure fixing unit (fixing roller 188) based on the heat roller. When using an ink containing an active light-curable resin, such as ultraviolet-curable resin as described above, a device that irradiates the active light, such as a UV lamp or an ultraviolet LD (laser diode) array, is arranged instead of the fixing roller 188 for heat fixing.

<Paper Output Unit>

The paper output unit 122 is arranged subsequently to the fixing unit 120. The paper output unit 122 includes an output tray 192, and a transfer drum 194, a conveyance belt 196 and a tensioning roller 198 are arranged between the output tray 192 and the fixing drum 184 of the fixing unit 120 so as to oppose same. The recording medium 124 is sent to the conveyance belt 196 by the transfer drum 194 and outputted to the output tray 192. Although the details of the paper conveyance mechanism constituted of the conveyance belt 196 are not shown, the leading end portion of the recording medium 124 after printing is held by a gripper on a bar (not shown) which spans between the endless conveyance belts 196, and the recording medium 124 is conveyed about the output tray 192 due to the rotation of the conveyance belts 196.

Although not shown in FIG. 17, the inkjet recording apparatus 100 according to the present embodiment further includes: an ink storing and loading unit, which supplies the inks to the inkjet heads 172M, 172K, 172C and 172Y; a device which supplies the treatment liquid to the treatment liquid deposition unit 114; a head maintenance unit, which carries out cleaning (nozzle surface wiping, purging, nozzle suction, and the like) of the inkjet heads 172M, 172K, 172C and 172Y; a position determination sensor, which determines the position of the recording medium 124 in the paper conveyance path; a temperature sensor, which determines the temperature of the respective units of the inkjet recoding apparatus 100; and so on.

<Description of Control System>

Figure 18:
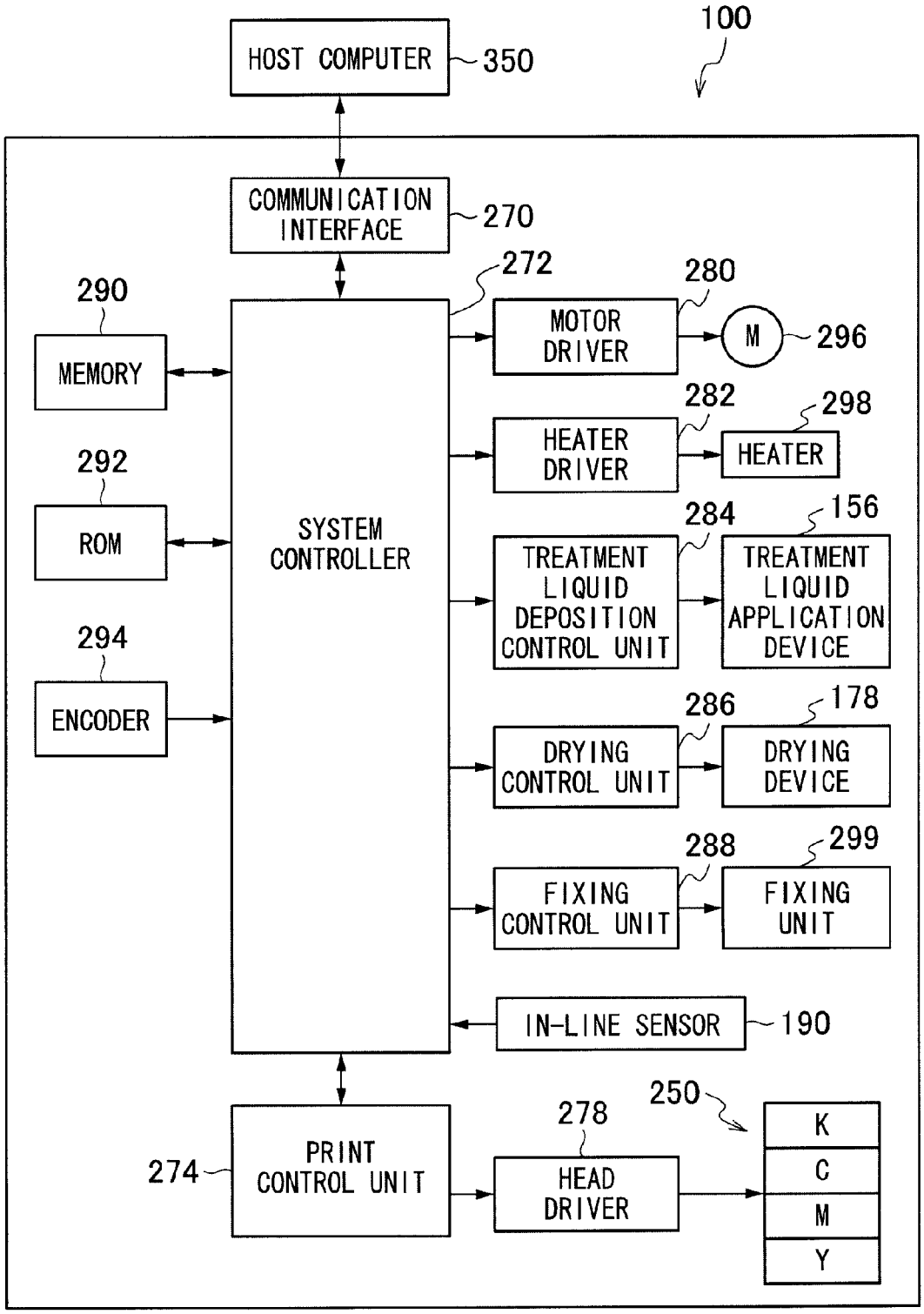
FIG. 18 is a block diagram showing the principal composition of the inkjet recording apparatus according to the embodiment of the present invention.

FIG. 18 is a block diagram showing the main configuration of the system of the inkjet recoding apparatus 100. As shown in FIG. 18, the inkjet recording apparatus 100 includes a communication interface 270, a system controller 272, a print controller 274, an image buffer memory 276, a head driver 278, a motor driver 280, a heater driver 282, a treatment liquid deposition control unit 284, a drying control unit 286, a fixing control unit 288, a memory 290, a ROM 292, an encoder 294, and the like.

The communication interface 270 is an interface unit for receiving image data sent from a host computer 350. A serial interface such as USB (Universal Serial Bus), IEEE1394, Ethernet, and wireless network, or a parallel interface such as a Centronics interface can be used as the communication interface 270. A buffer memory (not shown) can be mounted in this portion in order to increase the communication speed. The image data sent from the host computer 350 is received by the inkjet recording apparatus 100 through the communication interface 270, and is temporarily stored in the memory 290.

The memory 290 is a storage device for temporarily storing image data inputted through the communication interface 270, and the data is written and read to and from the memory 290 through the system controller 272. The memory 290 is not limited to a memory composed of semiconductor elements, and a hard disk drive or another magnetic medium can be used.

The system controller 272 is constituted of a central processing unit (CPU) and peripheral circuits thereof, and the like. The system controller 272 functions as a control device for controlling the whole of the inkjet recording apparatus 100 in accordance with a prescribed program, as well as a calculation device for performing various calculations. More specifically, the system controller 272 controls the various sections, such as the communication interface 270, the print controller 274, the motor driver 280, the heater driver 282, the treatment liquid deposition control unit 284 and the like, as well as controlling communications with the host computer 350 and writing and reading to and from the memory 290, and it also generates control signals for controlling the motor 296 and the heater 298 of the conveyance system.

The program executed by the CPU of the system controller 272, the various types of data which are required for control procedures, and the like are stored in the ROM 292. The ROM 292 can be a non-writeable storage device, or can be a rewriteable storage device, such as an EEPROM. The memory 290 is utilized as a temporary storage area of the image data, and also utilized as an expansion area of the program and a calculation operation area of the CPU.

The motor driver 280 is a driver which drives the motor 296 in accordance with instructions from the system controller 272. In FIG. 18, various motors arranged in the respective units of the inkjet recoding apparatus 100 are represented by the reference numeral 296. For example, the motors 296 include a motor that drives the rotation of the paper supply drum 152, a motor that drives the rotation of the treatment liquid drum 154, a motor that drives the rotation of the image formation drum 170, a motor that drives the rotation of the drying drum 176, a motor that drives the rotation of the fixing drum 184, a motor that drives the rotation of the transfer drum 194, and the like, shown in FIG. 17, and a drive motor of the pump for producing a negative pressure through the suction holes of the image formation drum 170, a motor of a withdrawal mechanism which moves the head units of the inkjet heads 172M, 172K, 172C and 172Y to a maintenance area apart from the image formation drum 170, and the like.

The heater driver 282 is a driver which drives the heater 298 in accordance with instructions from the system controller 272. In FIG. 18, various heaters arranged in the respective units of the inkjet recoding apparatus 100 are represented by the reference numeral 298. For example, the heaters 298 include a pre-heater (not shown) for previously heating the recording medium 124 to a suitable temperature in the paper supply unit 112.

The print controller 274 has a signal processing function for performing various tasks, compensations, and other types of processing for generating print control signals from the image data stored in the memory 290 in accordance with commands from the system controller 272 so as to supply the generated print data (dot data) to the head driver 278.

In general, the dot data is generated by subjecting the multiple-tone image data to color conversion processing and half-tone processing. The color conversion processing is processing for converting image data represented by the sRGB system, for instance (e.g., 8-bit RGB color image data) into image data of the respective colors of inks used in the inkjet recording apparatus 100 (KCMY color data, in the present embodiment).

The half-tone processing is processing for converting the color data of the respective colors generated by the color conversion processing into dot data of respective colors (KCMY dot data, in the present embodiment) by an error diffusion method, a threshold matrix method, or the like.

The prescribed signal processing is carried out in the print controller 274, and the ejection amount and the ejection timing of the ink droplets from the respective print heads 250 (the inkjet heads 172M, 172K, 172C, 172Y of the respective colors are comprehensively denoted with the numeral 250 in FIG. 18) are controlled through the head driver 278, on the basis of the obtained dot data. By this means, prescribed dot size and dot positions can be achieved.

An image buffer memory (not shown) is arranged in the print controller 274, and image data, parameters, and other data are temporarily stored in the image buffer memory when the image data is processed in the print controller 274. Also possible is a mode in which the print controller 274 and the system controller 272 are integrated to form a single processor.

To give a general description of the sequence of processing from image input to print output, image data to be printed (original image data) is inputted from an external source through the communication interface 270, and is accumulated in the memory 290. At this stage, RGB image data is stored in the memory 290, for example. In the inkjet recording apparatus 100, an image which appears to have a continuous tonal graduation to the human eye is formed by changing the deposition density and the dot size of fine dots created by ink (coloring material), and therefore, it is necessary to convert the inputted digital image into a dot pattern which reproduces the tonal graduations of the image (namely, the light and shade toning of the image) as faithfully as possible. Therefore, original image data (RGB data) stored in the memory 290 is sent through the system controller 272 to the print controller 274, and is converted to the dot data for each ink color by half-tone processing using a threshold matrix method, an error diffusion method or the like. In other words, the print controller 274 performs processing for converting the inputted RGB image data into dot data for the four colors of K, C, M and Y The dot data thus generated by the print controller 274 is stored in the image buffer memory (not shown).

The head driver 278 outputs the drive signals for driving the pressure generating elements 30 corresponding to the respective nozzles of the head 250 on the basis of the print data supplied from the print controller 274 (in other words, the dot data stored in the image buffer memory 276). The head driver 278 can also incorporate a feedback control system for maintaining uniform drive conditions in the heads 250.

By applying the drive signals outputted from the head driver 278 to the heads 250 in this way, droplets of the inks are ejected from the corresponding nozzles. The image is formed on the recording medium 124 by controlling the ink ejection from the heads 250 while conveying the recording medium 124 at a prescribed speed. The inkjet recording apparatus 100 in the present embodiment employs the drive method in which the drive power waveform signal is applied commonly to each of the heads 250 (head modules), and the switches 62 (shown in FIG. 2) connected to the individual electrodes of the respective pressure generating elements 30 are caused to close and open in accordance with the ejection timings of the corresponding nozzles 22, so that droplets of the ink are ejected from the nozzles 22 corresponding to the pressure generating elements 30 in the "on" state.

The part including the head driver 278 and the print control unit 274 (including the built-in image buffer memory) corresponds to the head control unit 70 shown in FIG. 16. The system controller 272 in FIG. 18 corresponds to the upper-level data control unit 80 shown in FIG. 16.

The treatment liquid deposition control unit 284 controls the operation of the treatment liquid application device 156 (shown in FIG. 16) in accordance with instructions from the system controller 272. The drying control unit 286 controls the operation of the solvent drying device 178 (shown in FIG. 16) in accordance with instructions from the system controller 272.

The fixing control unit 288 controls the operation of a fixing unit 299 which is constituted of the halogen heater 186 and the fixing roller 188 (shown in FIG. 16) of the fixing unit 120 in accordance with instructions from the system controller 272.

As described with reference to FIG. 16, the in-line sensor 190 is the block including the image sensor, which reads in the image printed on the recording medium 124, performs various signal processing operations and the like, and determines the print situation (presence/absence of ejection, variation in droplet deposition, optical density, and the like), and these determination results are supplied to the system controller 272 and the print controller 274.

The print controller 274 implements various corrections (such as ejection failure correction and density correction) with respect to the heads 250, on the basis of the information obtained from the in-line sensor 190, and also implements control for carrying out cleaning operations (nozzle restoring operations), such as preliminary ejection, suction, or wiping, as and when necessary.

Modified Embodiment 1

The inkjet recording apparatus based on the method which forms an image by ejecting and depositing ink droplets directly onto the recording medium 124 (the direct recording method) has been described in the above embodiments; however, the application of the present invention is not limited to this, and the present invention can also be applied to an image forming apparatus of an intermediate transfer type which provisionally forms an image (primary image) on an intermediate transfer body, and then performs final image formation by transferring the primary image onto recording paper in a transfer unit.

Furthermore, the inkjet recording apparatus using the page-wide full-line type heads having the nozzle rows of the length corresponding to the full width of the recording medium (the single-pass image forming apparatus which completes an image by a single sub-scanning action) has been described in the above embodiments; however, the application of the present invention is not limited to this, and the present invention can also be applied to an inkjet recording apparatus which performs image recording by means of a plurality of scanning actions by moving short recording heads, such as serial heads (shuttle scanning heads), or the like.

<Device for Causing Relative Movement of Head and Paper>

In the above-described embodiments, the recording medium is conveyed with respect to the stationary heads; however, in implementing the present invention, it is also possible to move heads with respect to a stationary recording medium (image formation receiving medium).

<Recording Medium>

"Recording medium" is a general term for a medium on which dots are recorded by droplets ejected from the inkjet head, and this includes various terms, such as print medium, recording medium, image forming medium, image receiving medium, ejection receiving medium, and the like. In implementing the present invention, there are no particular restrictions on the material or shape, or other features, of the recording medium, and it is possible to employ various different media, irrespective of their material or shape, such as continuous paper, cut paper, seal paper, OHP sheets or other resin sheets, film, woven cloth, nonwoven cloth, a printed substrate on which a wiring pattern, or the like, is formed, or a rubber sheet.

<Ejection Method>

The device which generates pressure (ejection energy) for ejection in order to eject droplets from the nozzles of the inkjet head is not limited to the piezoelectric actuator (piezoelectric element). Apart from the piezoelectric element, it is also possible to employ pressure generating elements (ejection energy generating elements) of various kinds, such as a heater (heating element) in a thermal method (a method which ejects ink by using the pressure produced by film boiling caused by heat from the heater), or various actuators based on other methods. A corresponding energy generating element is arranged in the flow channel structure in accordance with the ejection method of the head.

<Embodiment of Application to Thermal Method>

In the case of a liquid ejection head including ejectors based on the thermal method, it is possible to achieve a composition in which no droplet is substantially ejected from a thermal ejector even when a driving waveform section (main waveform) that is to cause actual ejection is applied to the thermal ejector, by applying a subsidiary waveform, which is of a level that does not cause ejection, to the thermal ejector prior to the application of the subsequent main waveform.

The principle underlying this is as follows. The ejection principle of the thermal method is that a current is passed through a heater (heating element), then the thereby generated heat causes ink liquid in contact with the surface of the heater to evaporate (boil), and the thereby generated force causes a droplet of the ink liquid to be ejected. It is possible to suppress ejection, by carrying out drive control (current) processing in order to reduce the ejection efficiency of this heating and boiling actions.

For example, if a weak current is initially passed through the heater prior to the application of the main waveform, then the heat generated by the application of the subsequent main waveform is not readily transmitted to the ink liquid because the ink liquid has been caused to separate from the surface of the heater.

In this way, by the composition where a current which is sufficient to slightly separate (float up) the liquid (ink) from the surface of the heater is applied prior to the application of the main waveform in such a manner that the ink is not substantially ejected by the application of the subsidiary waveform, and then the main waveform is applied, it is possible to cause the heat generated by the application of the main waveform to be not readily transmitted to the ink.

Thus, it is possible to achieve a state where no ink is substantially ejected when the subsidiary waveform and the main waveform are consecutively applied.

Application Embodiments of the Present Invention

In the above embodiments, the applications to the inkjet recording apparatus for graphic printing have been described; however, the scope of application of the present invention is not limited to this. For example, the present invention can also be applied widely to inkjet systems which obtain various shapes and patterns using functional liquid material, such as a wire printing apparatus which forms an image of a wire pattern for an electronic circuit, manufacturing apparatuses for various devices, a resist printing apparatus which uses resin liquid as a functional liquid for ejection, a color filter manufacturing apparatus, a fine structure forming apparatus for forming a fine structure using a material for material deposition, or the like.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a plurality of nozzles each of which is configured to serve as an ejection port from which a droplet of liquid is ejected;

a plurality of pressure generating elements which are arranged correspondingly to the nozzles, each of the pressure generating elements being configured to generate ejection energy to eject the droplet from a corresponding one of the nozzles;

a circuit control device including a plurality of switches of which first ends are connected respectively to the pressure generating elements corresponding to the nozzles;

a voltage waveform generating device configured to generate a voltage waveform to be supplied to second ends of the switches of which the first ends are connected to the pressure generating elements; and a switch control device which outputs a control signal to cause each of the switches to close and open, wherein the voltage waveform generated by the voltage waveform generating device has a waveform such that, when one of the switches is caused to close and open according to the control signal so that a portion of the voltage waveform is applied to one of the pressure generating elements connected to the one of the switches, a droplet of the liquid is ejected from one of the nozzles corresponding to the one of the pressure generating elements to which the portion of the voltage waveform has been applied, whereas when a whole of the voltage waveform is applied to the one of the pressure generating elements, no droplet of the liquid is substantially ejected from the one of the nozzles corresponding to the one of the pressure generating elements to which the whole of the voltage waveform has been applied.

2. The liquid ejection apparatus as defined in claim 1, wherein the voltage waveform includes a main waveform section and a subsidiary waveform section, the main waveform section being for ejection driving to cause ejection of the droplet from the one of the nozzles when the main waveform section is applied to the one of the pressure generating elements, the subsidiary waveform section being for suppressing the ejection of the droplet from the one of the nozzles when the subsidiary waveform section is applied to the one of the pressure generating elements in combination with the main waveform section.

3. The liquid ejection apparatus as defined in claim 2, wherein the subsidiary waveform section precedes the main waveform section in the voltage waveform.

4. The liquid ejection apparatus as defined in claim 2, wherein the voltage waveform is formed by combining the subsidiary waveform section and the main waveform section in such a manner that a pressure wave generated in the liquid by the one of the pressure generating elements being applied with the subsidiary waveform section cancels at least a portion of a pressure wave generated in the liquid by the one of the pressure generating elements being applied with the main waveform section.

5. The liquid ejection apparatus as defined in claim 4, further comprising:

a liquid ejection head including a plurality of ejectors which respectively have: the nozzles; a plurality of pressure chambers which are connected respectively to the nozzles; and the pressure generating elements which are arranged correspondingly to the pressure chambers, wherein:

the subsidiary waveform section includes a first waveform element which produces a voltage change of one of fall and rise;

the main waveform section includes a second waveform element which produces a voltage change of the one of fall and rise same with the first waveform element of the subsidiary waveform section;

a pressure chamber system including one of the pressure chambers and the liquid contained in the one of the pressure chambers has a resonance period of Tc; and the first waveform element of the subsidiary waveform section and the second waveform element of the main waveform section are separated from each other by a time interval of $(2n+1)\times(Tc/2)$, where n is an integer not less than 0.

6. The liquid ejection apparatus as defined in claim 4, further comprising:

a liquid ejection head including a plurality of ejectors which respectively have: the nozzles; a plurality of pressure chambers which are connected respectively to the nozzles; and the pressure generating elements which are arranged correspondingly to the pressure chambers, wherein:

the subsidiary waveform section includes a first waveform element which produces a voltage change of one of fall and rise;

the main waveform section includes a second waveform element which produces a voltage change of another of fall and rise opposing to the first waveform element of the subsidiary waveform section;

a pressure chamber system including one of the pressure chambers and the liquid contained in the one of the pressure chambers has a resonance period of Tc; and the first waveform element of the subsidiary waveform section and the second waveform element of the main waveform section are separated from each other by a time interval of $(n+1)\times Tc$, where n is an integer not less than 0.

7. The liquid ejection apparatus as defined in claim 2, wherein a voltage amplitude of the subsidiary waveform section is not smaller than a voltage amplitude of the main waveform section.

8. The liquid ejection apparatus as defined in claim 2, wherein a lowest voltage in the subsidiary waveform section is not higher than a lowest voltage in the main waveform section.

9. The liquid ejection apparatus as defined in claim 2, wherein the voltage waveform includes a plurality of the main waveform sections and a plurality of the subsidiary waveform sections in one recording period.

10. The liquid ejection apparatus as defined in claim 2, wherein a part of the subsidiary waveform section includes a waveform element which produces a stepwise voltage rise.

11. The liquid ejection apparatus as defined in claim 2, wherein a part of the subsidiary waveform section includes a waveform element which produces a voltage rise following an S-shaped curve.

12. The liquid ejection apparatus as defined in claim 2, wherein:

the subsidiary waveform section precedes the main waveform section in the voltage waveform; and when the subsidiary waveform section is applied to the one of the pressure generating elements, an air bubble is drawn inside the nozzle corresponding to the one of the pressure generating elements, and ejection due to be caused by the main waveform section is suppressed by the air bubble.

13. An inkjet apparatus, comprising:

the liquid ejection apparatus as defined in claim 1; and a medium conveyance device which conveys a recording medium on which droplets ejected from the nozzles are deposited.

14. An ejection control method for a liquid ejection apparatus which includes: a plurality of nozzles each of which is configured to serve as an ejection port from which a droplet of liquid is ejected; a plurality of pressure generating elements which are arranged correspondingly to the nozzles, each of the pressure generating elements being configured to generate ejection energy to eject the droplet from a corresponding one of the nozzles; a circuit control device including a plurality of switches of which first ends are connected respectively to the pressure generating elements corresponding to the nozzles; a voltage waveform generating device configured to generate a voltage waveform to be supplied to second ends of the switches of which the first ends are connected to the pressure generating elements; and a switch control device which outputs a control signal to cause each of the switches to close and open, the ejection control method comprising the steps of:

supplying the voltage waveform to the second ends of the switches, the voltage waveform having a waveform such that when a whole of the voltage waveform is applied to one of the pressure generating elements, no droplet of the liquid is substantially ejected from one of the nozzles corresponding to the one of the pressure generating elements to which the whole of the voltage waveform has been applied; and causing one of the switches to close and open by the control signal so that a portion of the voltage waveform is applied to one of the pressure generating elements connected to the one of the switches, and thereby ejecting a droplet of the liquid from one of the nozzles corresponding to the one of the pressure generating elements to which the portion of the voltage waveform has been applied.

15. The ejection control method as defined in claim 14, wherein the voltage waveform includes a main waveform section and a subsidiary waveform section, the main waveform section being for ejection driving to cause ejection of the droplet from the one of the nozzles when the main waveform section is applied to the one of the pressure generating elements, the subsidiary waveform section being for suppressing the ejection of the droplet from the one of the nozzles when the subsidiary waveform section is applied to the one of the pressure generating elements in combination with the main waveform section.

16. The ejection control method as defined in claim 15, wherein the voltage waveform is formed by combining the subsidiary waveform section and the main waveform section in such a manner that a pressure wave generated in the liquid by the one of the pressure generating elements being applied with the subsidiary waveform section cancels at least a portion of a pressure wave generated in the liquid by the one of the pressure generating elements being applied with the main waveform section.

17. The ejection control method as defined in claim 16, wherein:

the liquid ejection apparatus further includes a liquid ejection head including a plurality of ejectors which respectively have: the nozzles; a plurality of pressure chambers which are connected respectively to the nozzles; and the pressure generating elements which are arranged correspondingly to the pressure chambers;

the subsidiary waveform section includes a first waveform element which produces a voltage change of one of fall and rise;

the main waveform section includes a second waveform element which produces a voltage change of the one of fall and rise same with the first waveform element of the subsidiary waveform section;

a pressure chamber system including one of the pressure chambers and the liquid contained in the one of the pressure chambers has a resonance period of Tc; and the first waveform element of the subsidiary waveform section and the second waveform element of the main waveform section are separated from each other by a time interval of $(2n+1)\times(Tc/2)$, where n is an integer not less than 0.

18. The ejection control method as defined in claim 16, wherein:

the liquid ejection apparatus further includes a liquid ejection head including a plurality of ejectors which respectively have: the nozzles; a plurality of pressure chambers which are connected respectively to the nozzles; and the pressure generating elements which are arranged correspondingly to the pressure chambers;

the subsidiary waveform section includes a first waveform element which produces a voltage change of one of fall and rise;

the main waveform section includes a second waveform element which produces a voltage change of another of fall and rise opposing to the first waveform element of the subsidiary waveform section;

a pressure chamber system including one of the pressure chambers and the liquid contained in the one of the pressure chambers has a resonance period of Tc; and the first waveform element of the subsidiary waveform section and the second waveform element of the main waveform section are separated from each other by a time interval of $(n+1)\times Tc$, where n is an integer not less than 0.

19. The ejection control method as defined in claim 15, wherein the voltage waveform includes a plurality of the main waveform sections and a plurality of the subsidiary waveform sections in one recording period.

20. The ejection control method as defined in claim 15, wherein:

the subsidiary waveform section precedes the main waveform section in the voltage waveform; and when the subsidiary waveform section is applied to the one of the pressure generating elements, an air bubble is drawn inside the nozzle corresponding to the one of the pressure generating elements, and ejection due to be caused by the main waveform section is suppressed by the air bubble.

* * * * *